US007111763B2

(12) United States Patent
Masuda

(10) Patent No.: US 7,111,763 B2
(45) Date of Patent: Sep. 26, 2006

(54) FLUID-STORING CONTAINER

(76) Inventor: Masatoshi Masuda, 2,9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 85 days.

(21) Appl. No.: 10/714,237

(22) Filed: Nov. 14, 2003

(65) Prior Publication Data

US 2004/0124212 A1 Jul. 1, 2004

(30) Foreign Application Priority Data

Dec. 26, 2002 (JP) ..... 2002-375799

(51) Int. Cl.
*B67D 5/042* (2006.01)

(52) U.S. Cl. ..... 222/386.5; 222/491; 222/105

(58) Field of Classification Search ..... 222/386.5, 222/211–213, 482, 491, 481.5, 105
See application file for complete search history.

(56) References Cited

U.S. PATENT DOCUMENTS 3,596,808 A * 8/1971 Corsette ..... 222/321.9
3,698,595 A * 10/1972 Gortz et al. ..... 222/95
4,168,788 A * 9/1979 Quinn ..... 222/383.1
5,183,184 A 2/1993 Ranalletta et al.
5,273,191 A * 12/1993 Meshberg ..... 222/105
5,343,901 A * 9/1994 Meshberg ..... 141/2
5,370,272 A 12/1994 Gueret
6,332,726 B1 * 12/2001 Yamamoto et al. ..... 401/183
6,505,986 B1 * 1/2003 Oder ..... 401/183

FOREIGN PATENT DOCUMENTS

EP 0 473 994 A2 11/1992
EP 0 992 438 A1 4/2000
JP 2001-335087 12/2001

* cited by examiner

*Primary Examiner*—Michael Mar
*Assistant Examiner*—Melvin Cartagena
(74) *Attorney, Agent, or Firm*—Knobbe, Martens, Olson & Bear LLP

(57) ABSTRACT

A fluid-storing portion 4 includes an external container (110), an internal container (120), and a coupling material (140) which forms an internal space (130) shielded from the outside between the internal container (120) and the external container (110). When the volume of the internal container (120) is decreased, the internal space (130) is depressurized and receives force in a direction toward the internal space (130) from outside. Consequently, air flows into the internal space (130) from the outside by the action of a runoff prevention mechanism (144 and 147) of the coupling material (140).

24 Claims, 23 Drawing Sheets

FLUID-STORING CONTAINER

BACKGROUND OF THE INVENTION

1. Field of the Invention

The present invention generally relates to a fluid-storing container comprising an external container and an internal container which stores a fluid.

2. Description of the Related Art

A double-wall fluid storing container is disclosed in Japanese Patent Laid-open No. 2001-335087, for example. In the publication, a fluid-storing container comprises an internal container incorporated in an external container, wherein the internal container can be filled with a fluid and is made of a material which changes the shape inward as the inside of the internal container is depressurized, and a fluid discharge pump is installed at an opening portion of the internal container. The opening portion of the internal container and the fluid discharge pump in this fluid-storing container are installed air-tightly inside the internal container. Further, a space shielded from the outside by a lid is formed between the external container and the internal container. A small air hole is provided in the external container to prevent pressure inside the space from remaining low as the volume of the internal container decreases. This enables the fluid stored to be dispensed by applying pressure on the external container regardless of the remaining amount of the fluid stored, while maintaining the outer shape of the external container. The air hole is small enough to support pressure in the space while pressing the external container to press the internal container.

However, this fluid-storing container has problems: When the fluid stored leaks into the space formed between the external container and the internal container due to damage made to the internal container, etc., the fluid leaking into the space leaks outside the external container through the air hole provided in the external container. Additionally, it is difficult to use containers available on the market as the external containers without modifications, because providing the air hole in the external containers is required.

SUMMARY OF THE INVENTION

The present invention has been achieved to solve the above-mentioned problems. An object of the present invention is to provide a fluid-storing container which can prevent a leaked stored fluid in a space formed between the container main body and the internal container from flowing outside the container main body. Another object of the present invention is to provide a structure which can use a container available on the market or a container with no air hole as an external container.

The present invention can be practiced in various ways including, but not limited to, embodiments described below, wherein numerals used in the drawings are used solely for the purpose of ease in understanding of the embodiments which should not be limited to the numerals. Further, different terms or names may be designated to the same element, and in that case, the different terms or names can interchangeably be used.

In an embodiment, the present invention provides a coupling structure for a double-wall container (e.g., 4, 4'), comprising: (i) a hollow portion (e.g., 140), having a through-hole (e.g., 141) as a fluid passage; (ii) a flange portion (e.g., 149) provided at an upper end of the hollow portion; (iii) a first connecting portion (e.g., 145) provided at a lower end of the hollow portion and adapted to be connected with an opening portion (e.g., 121, 121') of an inner container (e.g., 120, 120'); (iv) a second connecting portion (e.g., 146) provided in the vicinity of the flange portion and adapted to be connected with an opening portion (e.g., 111, 111') of an outer container (e.g., 110, 110'); (v) at least one annular elastic fin (e.g., 144) provided between the first connecting portion and the second connecting portion, said annular elastic fin extending outward and downward, wherein an edge (e.g., 150) of the fin is adapted to be in contact with an inner wall (e.g., 151) of the opening portion of the outer container, and (vi) at least one groove (e.g., 147) as an air passage formed and extending through the flange portion and the second connecting portion, said groove remaining open when the opening portion of the outer container is connected with the second connecting portion. More than one fin can be used, and in an embodiment, two or more fins (including 3, 4, 5, and 6 fins) can be used. Further, more than one groove can be used, and in an embodiment, two or more grooves (including 3, 4, 5, 6, 7, 8, 9, and 10 grooves) can be used. Preferably, the grooves are disposed symmetrically with respect to the axis of the coupling member.

In the above, a space (e.g., 130, 130') is defined between the inner container connected with the first connecting portion and the outer container connected with the second connecting portion. In an embodiment, the fin is such that when pressure in the space increases, the fin is deformed upward to increase sealing between the edge (e.g., 150) of the fin and the inner wall (e.g., 151) of the opening portion of the outer container, and when pressure in the space decreases, the fin is deformed downward to decrease sealing between the edge of the fin and the inner wall of the opening portion of the outer container, thereby introducing air into the space through the groove (e.g., 147). Thus, the negative pressure in the space due to the decrease in volume of the fluid stored in the inner container can be neutralized and does not interfere with discharging operation of the fluid. On the other hand, even when the inner container is damaged and causes leakage of the fluid into the space, the leaked fluid does not come out of the space through the fin. This aspect is effective especially when the container is a tube type container and pressure is applied to the container to discharge the fluid, because leaked fluid in the space is effectively prevented from being squeezed out of the space through the fin.

In the above, the hollow portion may preferably be cylindrical. However, the lateral cross section of the hollow portion may be a circle, oval, rounded triangle, rounded square, or other rounded polygon.

In an embodiment, the hollow portion may have at least one through-bore (e.g., 142) which communicates (i) a space (e.g., 130) defined between the inner container connected with the first connecting portion and the outer container connected with the second connecting portion, and (ii) a space defined on top (e.g., 155) of the flange portion, and which is isolated from the hollow of the hollow portion. The above configuration is effective especially when supplying a fluid into the inner container using a supply nozzle (e.g., 160) through the hollow portion after removing a nozzle portion (e.g., FIG. 8). The through-bore may be formed from between the fin and the first connecting portion to the top through the flange portion.

In the above, the structure may further comprise a through-bore closing disk (e.g., 143) adapted to be placed on top (e.g., 155) of the flange portion to close the through-bore without closing the hollow of the hollow portion. When a nozzle portion (e.g., 170, 170') is attached to the outer container at the opening portion, the disk is sandwiched between the nozzle portion and the flange portion, so that the disk closes the through-bore. Thus, when the container is in use, the through-bore may always be closed.

Any suitable methods can be used to connect the second connecting portion and the opening portion of the outer container, including methods using screw threads, an adhesive, press-fitting, welding, etc. In an embodiment, the second connecting portion may have an annular convex portion (e.g., 146) for press-fitting. Multiple annular convex portions can be used. Preferably, the opening portion of the outer container has a concave portion corresponding to the convex portion. However, no special structure for fitting may be necessary in the second connecting portion or the inner wall of the opening portion of the outer container, especially when the nozzle portion and the opening portion of the outer container are securely engaged wherein the flange portion is sandwiched.

In another aspect, the present invention provides a fluid-storing container comprising: (a) an inner container (e.g., 120, 120') for storing a fluid, which is flexible; (b) an outer container (e.g., 110, 110') in which the inner container is placed; (c) a coupling member (e.g., 140) having the coupling structure of any of the foregoing for coupling the inner container and the outer container, wherein an opening portion (e.g., 121, 121') of the inner container is connected with the first connecting portion (e.g., 145), an opening portion (e.g., 111, 111') of the outer container is connected with the second connecting portion (e.g., 146), and the edge of the fin (e.g., 150) is in contact with an inner wall (e.g., 151, 151') of the opening portion of the outer container; (d) a though-bore closing disk (e.g., 143) which is placed on top (e.g., 155) of the flange portion, wherein the through-bore closing disk closes the through-bore without closing the hollow of the hollow portion; and (e) a nozzle portion (e.g., 170, 171) which is secured to the opening portion of the outer container, between which the flange portion and the through-bore closing disk are sandwiched, wherein the fluid stored in the inner container is dispensed from a discharge port (e.g., 11, 13) of the nozzle portion through the hollow of the hollow portion. In this configuration, the outer container need not have an air hole for adjusting pressure in the space, and thus, a container readily available can be used without modifications.

In an embodiment, the nozzle portion (e.g., 170) comprises a nozzle head (e.g., 2) provided with the discharge port (e.g., 11), a lid (e.g., 180) secured to the opening portion (e.g., 111) of the outer container, and a pump mechanism (e.g., 1) for pumping the fluid from the inner container to the discharge port by pushing the nozzle head. In this embodiment, the container is used with a pump and the outer container can be rigid.

The pump mechanism is not limited, and any suitable pump mechanism can be used. Preferably, the pump mechanism (e.g., 1) may comprises: (i) a cylinder (e.g., 23) fitted inside the hollow portion (e.g., 141) of the coupling member, said cylinder having a lower end provided with a valve (e.g., 89); (ii) a piston (e.g., 83) which reciprocally slides against an inner wall (e.g., 25) of the cylinder to introduce the fluid therein through the valve and discharge the fluid through the discharge port; (iii) a hollow rod (e.g., 81+82) for moving the piston, said rod being connected to the discharge port (e.g., 11), wherein the fluid is discharged through the rod from the discharge port; and (iv) an urging member (e.g., 24) for urging the hollow rod upward.

In the above, the cylinder has a flange portion (e.g., 161), and the lid (e.g., 180) is secured to the opening portion (e.g., 111) of the outer container, between which the flange portion (e.g., 161) of the cylinder, the through-bore closing disk (e.g., 143), and the flange portion (e.g., 149) of the coupling member are sandwiched.

In an embodiment, the fluid-storing container may further comprise a suction tube (e.g., 90) having an upper end (e.g., 181) and a lower end (e.g., 182), said upper end being connected to the lower end of the cylinder, said lower end being disposed near a bottom (e.g., 183) of the inner container, wherein the fluid is introduced into the cylinder through the suction tube.

In another embodiment, the nozzle portion comprises a lid (e.g., 6) provided with the discharge port (e.g., 13), and a valve mechanism (e.g., 5) fitted inside the hollow portion of the coupling member. In this configuration, the container is a tube type container, and the outer container is pressed to discharge the fluid through the discharge port. Preferably, the discharge port is formed integrally with the lid portion.

In an embodiment, the valve mechanism comprises: (i) a valve seat portion (e.g., 240) fitted to an inner wall (e.g., 190) of the hollow portion, said valve seat portion having a fluid passage (e.g., 241); (ii) a valve body (e.g., 220) for closing and opening the fluid passage (e.g., 241); and (iii) a valve body support portion (e.g., 236+232+233) for supporting and urging the valve body downward. The valve seat portion may have an annular convex portion (e.g., 250) to be fitted to the inner wall of the hollow portion, although the valve seat can be fitted to the inner wall by any suitable methods including those using an adhesive, screw threads, press-fitting, welding, etc. Multiple annular convex portions can be provided. The inner wall may have a corresponding concave portion, although it is not required. In this configuration, the outer container may be flexible or re-shapeable to enhance discharging operation.

In still another embodiment, the present invention provides a fluid-storing container comprising: (A) an external container (e.g., 110) on top of which an opening portion (e.g., 111) is formed; (B) an internal container (e.g., 120) which comprises a flexible bag body having an opening portion (e.g., 121) and which can be housed inside said external container; (C) a nearly cylinder-shaped coupling material (e.g., 140) disposed at the opening portion of said internal container, which enables a fluid stored inside said internal container to be discharged outside via the opening portion of said external container and forms an internal space (e.g., 130) shielded from the outside between said internal container and said external container by fixing the opening portion of said internal container in the vicinity of the opening portion of said external container; and (D) a fluid discharge pump (e.g., 1) for discharging the fluid stored inside said internal container from a nozzle head (e.g., 2) disposed over said external container by pressing said nozzle head, wherein said coupling material comprises a runoff prevention mechanism (e.g., 144+147) which prevents the fluid from flowing out from said internal space to the outside and enables air to flow into said internal space from the outside. In the above, said fluid discharge pump may be disposed inside said nearly cylinder-shaped coupling material.

In yet another embodiment, the present invention provides a fluid-storing container comprising: (a) an external container (e.g., 110') on top of which an opening portion is formed; (b) an internal container (e.g., 120') which comprises a flexible bag body having an opening portion (e.g., 121') and which can be housed inside said external container; (c) a nearly cylinder-shaped coupling material (e.g., 140) disposed at the opening portion of said internal container, which enables a fluid stored inside said internal container to be discharged outside via the opening portion of said external container and forms an internal space shielded from the outside between said internal container and said external container by fixing the opening portion of said internal container in the vicinity of the opening portion of said external container; and (d) a valve mechanism (e.g., 5) for discharging the fluid stored inside said internal container from an upper portion (e.g., 111') of said external container by applying pressure to the fluid stored inside said internal container, wherein said coupling material comprises a runoff prevention mechanism (e.g., 144+147) which prevents the fluid from flowing out from said internal space to the outside and enables air to flow into said internal space from the outside. In the above, said valve mechanism may be disposed inside said nearly cylinder-shaped coupling material.

Further, in an embodiment of the foregoing structures, said runoff prevention mechanism comprises flexible leak-proof portions (e.g., 144) having an umbrella shape which opens toward an internal direction of the external container and which has maximum outer diameter portions (e.g., 150) contacting an inner wall (e.g., 151, 151') of the opening portion of the external container. Further, in an embodiment, said runoff prevention mechanism comprises a through-bore (e.g., 142) passing through between the outside and said internal space, which is formed in said coupling material, and a through-bore closing material (e.g., 143) closing said through-bore, which is disposed on top of said coupling material.

For purposes of summarizing the invention and the advantages achieved over the related art, certain objects and advantages of the invention have been described above and will be explained below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

FIG. 13(*b*) is a longitudinal sectional view of the same.

FIG. 23(*b*) is a longitudinal sectional view showing the valve mechanism used for the fluid-storing container when the opening portion opens.

Explanation of symbols used is as follows: 1: Fluid discharge pump; 2: Nozzle head; 3: Outer lid; 4: Fluid-storing portion; 5: Valve mechanism; 6: Discharge material; 11: Discharge portion; 12: Pressing portion; 13: Discharge port; 20: Concave portion; 23: Cylinder; 24: Coil spring; 41: Opening portion; 81: First coupling tube; 82: Second coupling tube; 83: Piston; 86: Tapered portion; 87: Supporting portion; 88: Coupling portion; 89: Valve body; 90: Suction tube; 91: Opening portion; 110: External container; 111: Opening portion; 120: Internal container; 121: Opening portion; 130: Internal space; 140: Coupling material; 141: Hollow portion; 142: Through-bore; 143: Through-bore closing material; 144: Leakproof portion; 145: First engaging portion; 146: Second engaging portion; 147: Groove portion; 148: Hollow portion; 220: Valve material; 221: Valve body; 222: Joined portion; 223: Inclined plane; 231: Engaging portion; 232: Coupling portion; 233: Valve material supporting portion; 236: Flexion; 238: Hole; 240: Valve seat material; 241: Opening portion.

DETAILED DESCRIPTION OF THE PREFERRED EMBODIMENT

The present invention is described in detail with referent to the drawings. However, the present invention should not be limited to the drawings.

Figure 7:
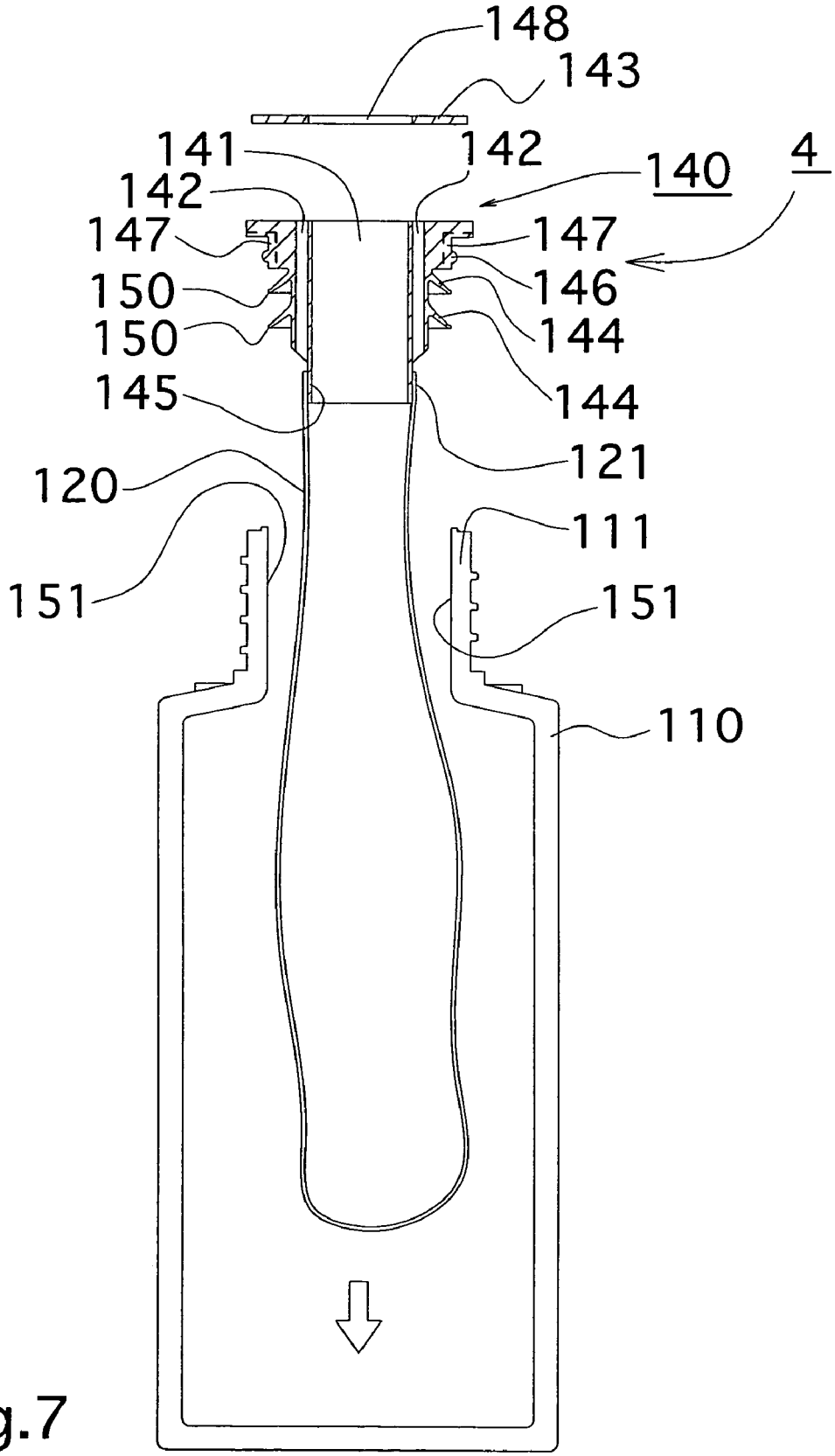
FIG. 7 is a longitudinal sectional view showing an assembly process of the fluid-storing portion of the fluid-storing container according to an embodiment of the present invention.
Figure 8:
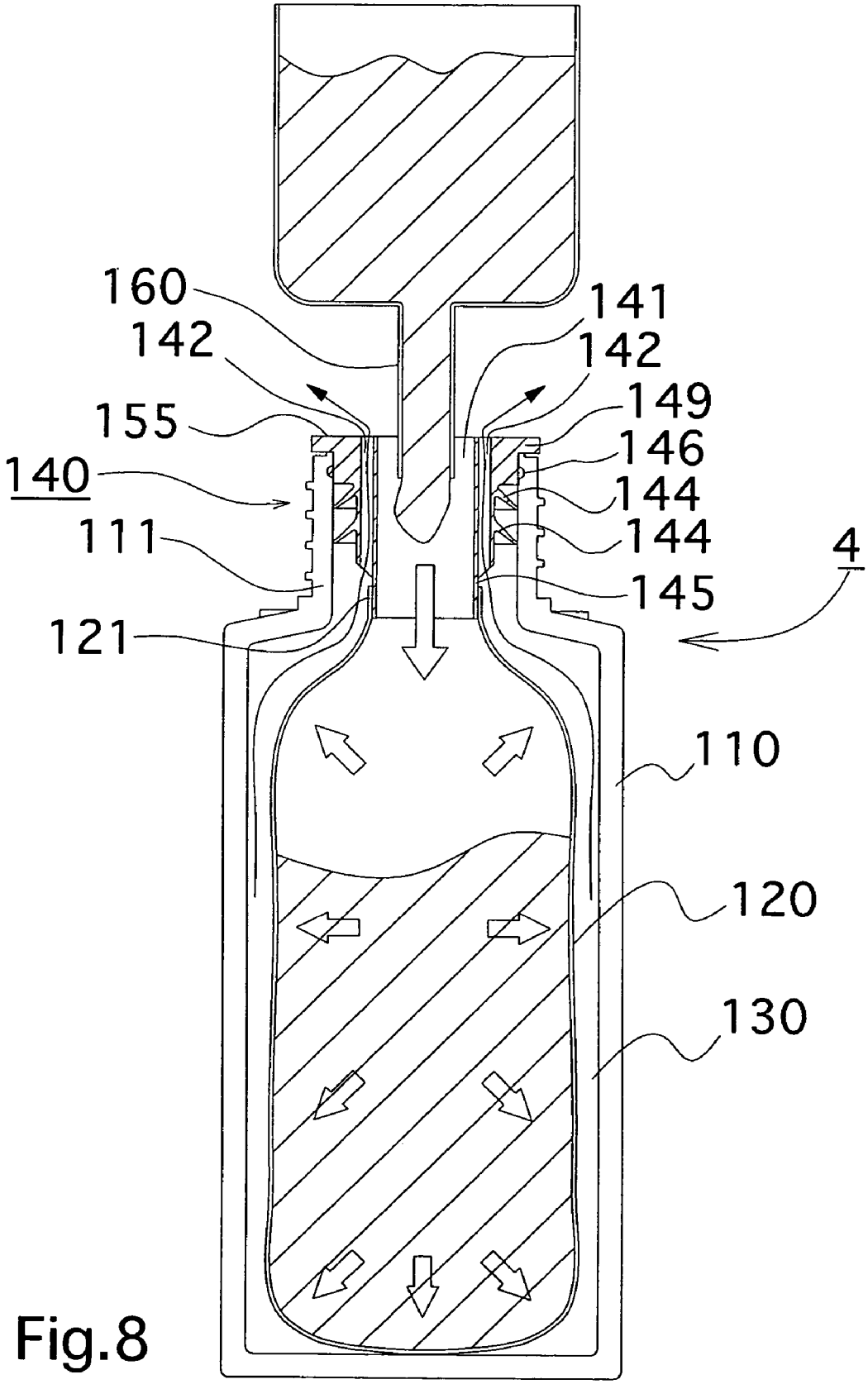
FIG. 8 is a longitudinal sectional view showing a fluid-filling process wherein the fluid is introduced into the inner container of the fluid-storing container according to an embodiment of the present invention.
Figure 11:
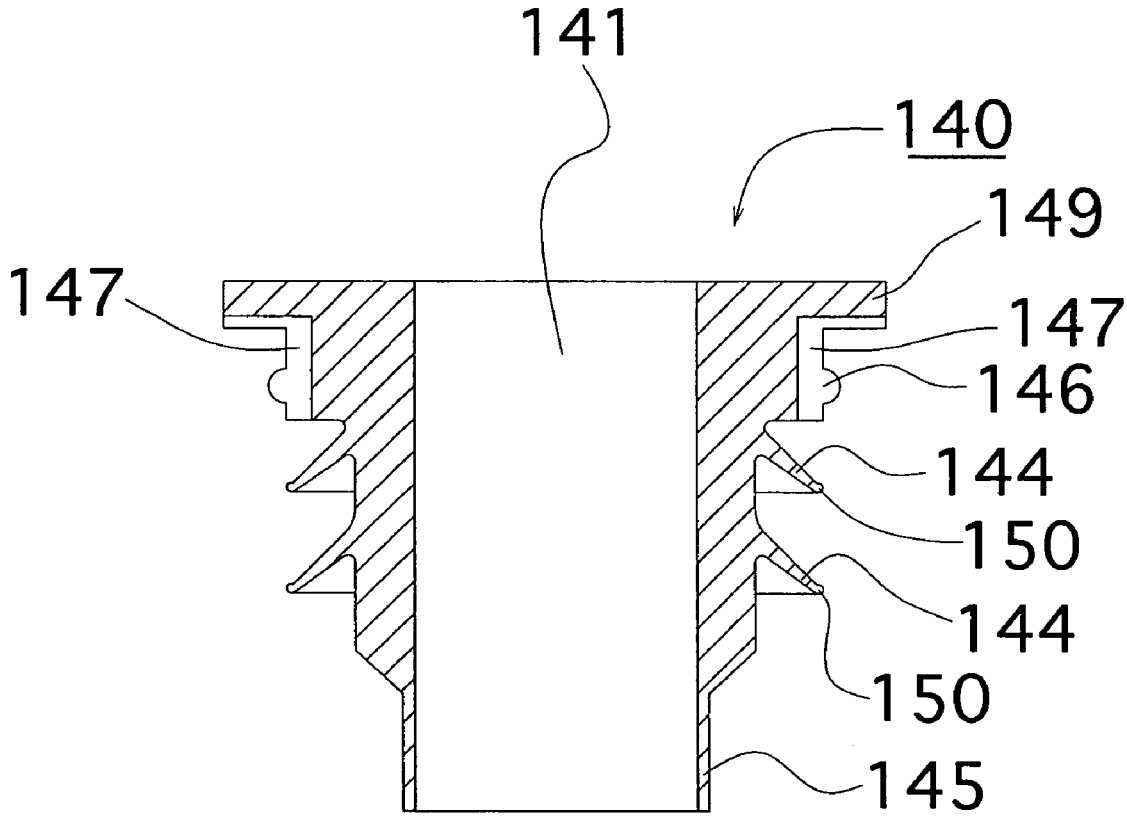
FIG. 11 is a B—B cross section indicated in FIG. 9.
Figure 12:
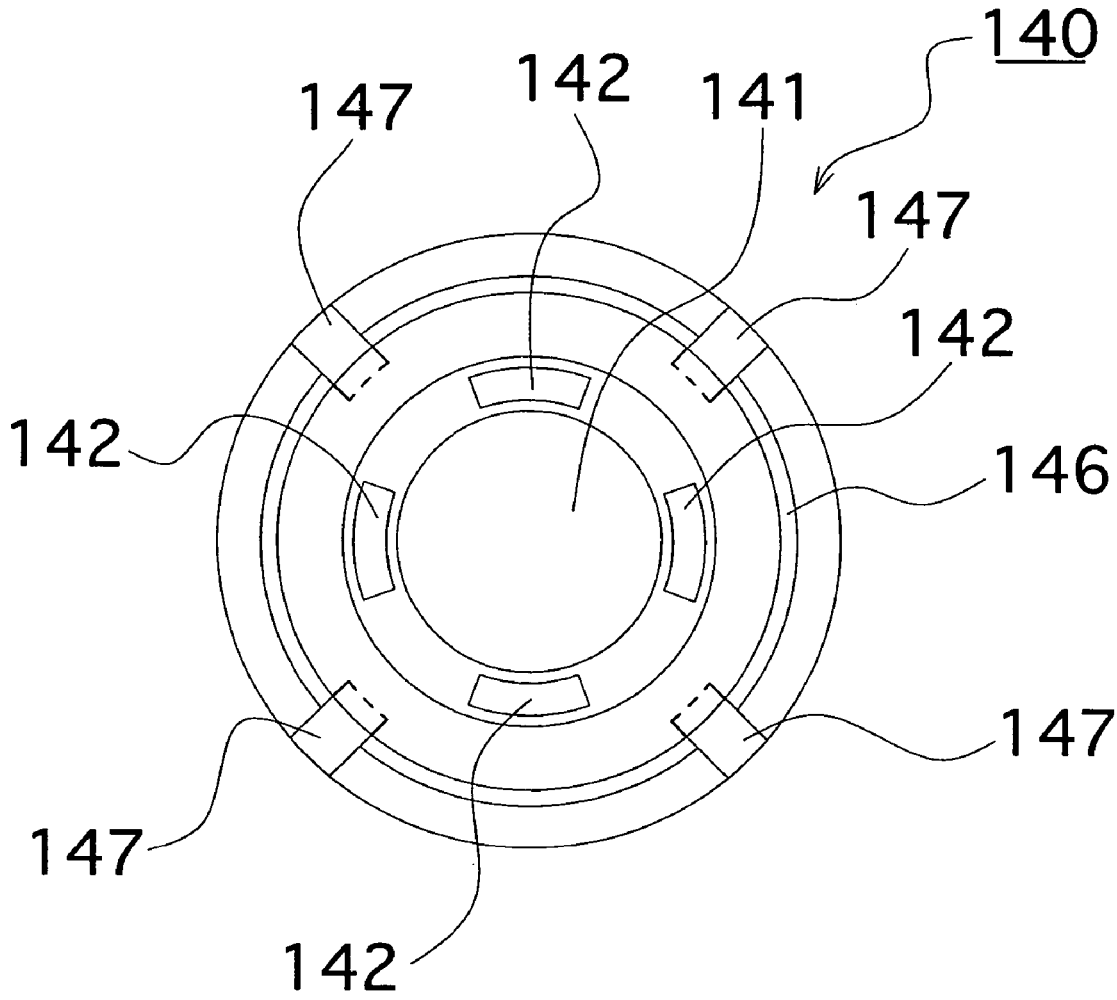
FIG. 12 is a backside view of the coupling material of the fluid-storing portion of the fluid-storing container according to an embodiment of the present invention.
Figure 13A:
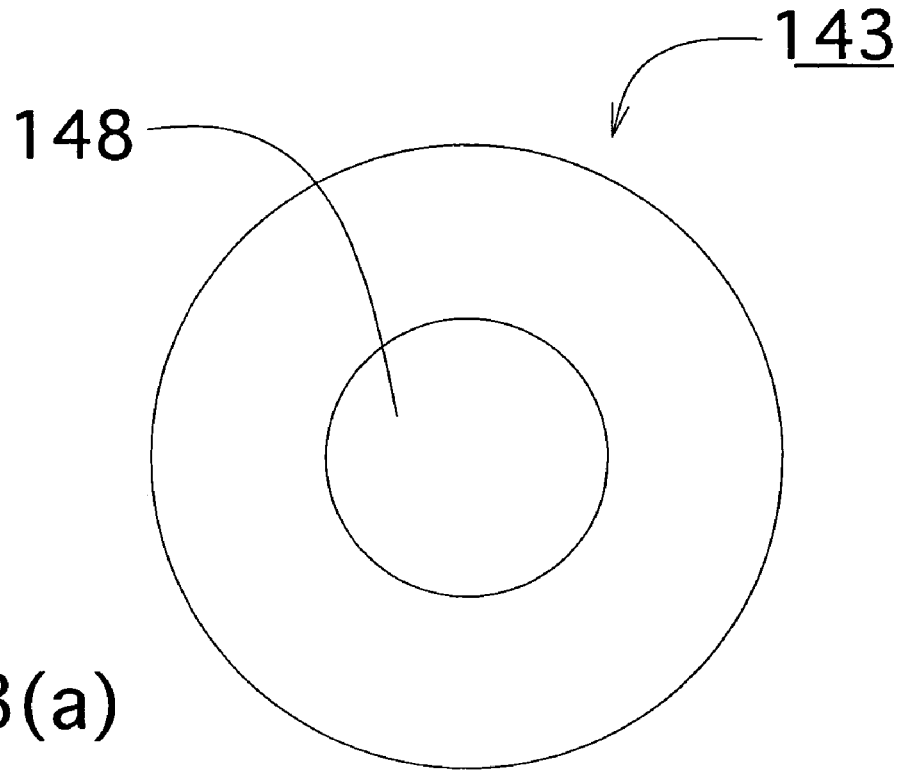
FIG. 13(*a*) is a plan view of a through-bore closing material of the fluid-storing portion of the fluid-storing container according to an embodiment of the present invention.
Figure 13B:
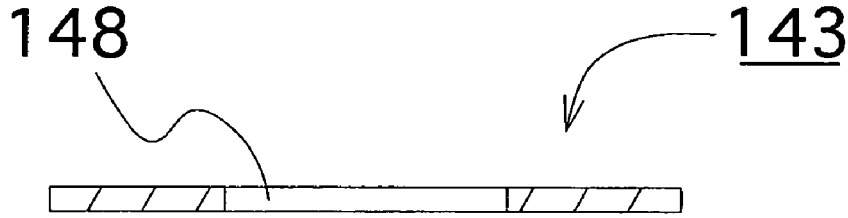

FIGS. 1–17 show a first embodiment of the present invention, where a discharge pump is installed in a container, whereas FIGS. 18–23 show a second embodiment of the present invention, where no pump is installed in a container, and the fluid is discharged by pressing the container itself. FIGS. 7 and 8 show an assembly process and a fluid filling process according to an embodiment of the present invention, and these processes can be applied to both the first and the second embodiments. FIGS. 9–12 show a coupling member according to an embodiment of the present invention, which can be used in both the first and the second embodiments. FIGS. 13(*a*) and 13(*b*) show a through-bore closing disk according to an embodiment of the present invention, which can be used in both the first and the second embodiments. In the present invention, any suitable nozzle portion can be used in addition to a nozzle portion 170 in the first embodiment and a nozzle portion 170' in the second embodiment, and the inner structure comprising a coupling member and an inner container can be used universally.

Figure 1:
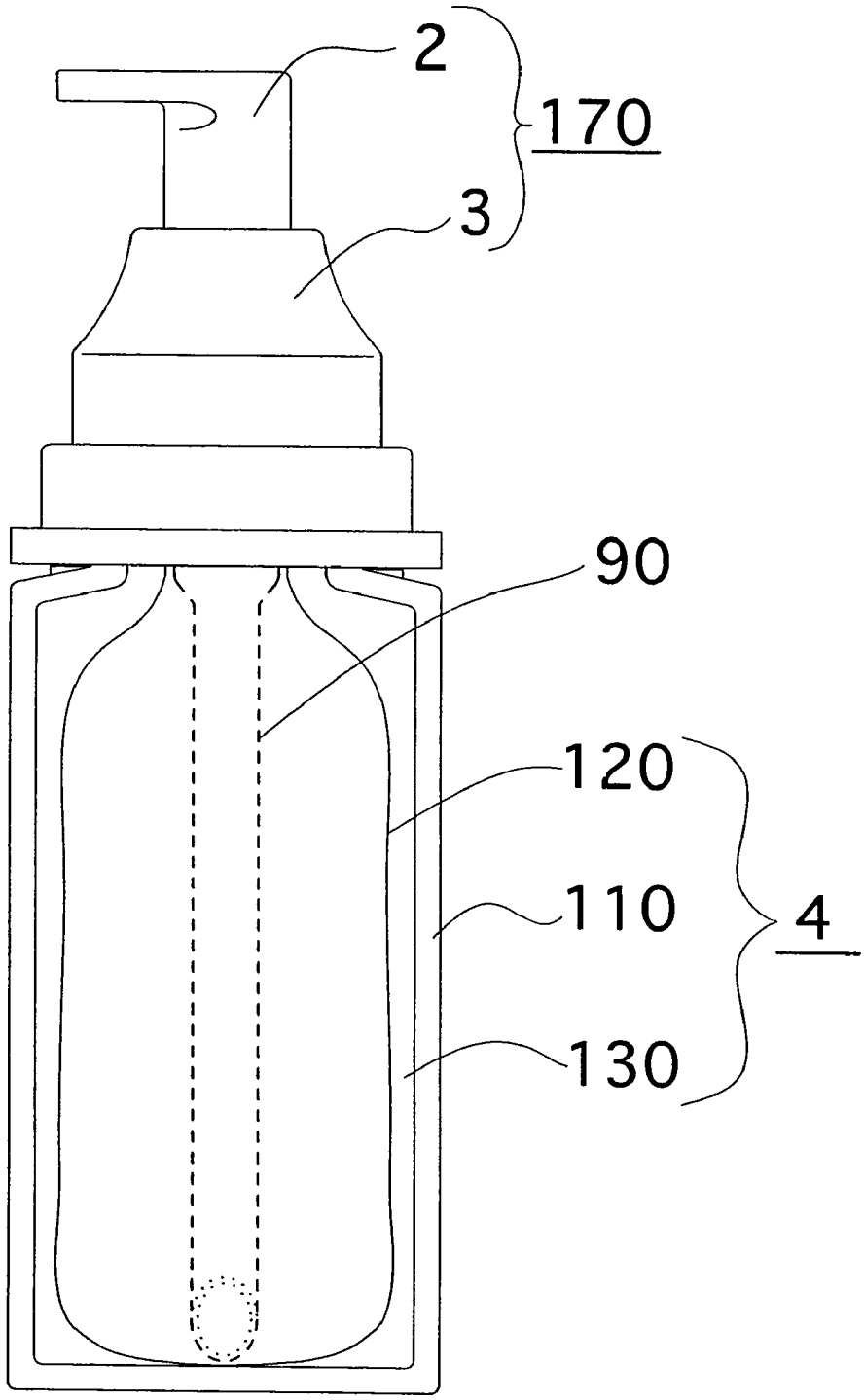
FIG. 1 is a partially sectional view showing a relevant part of the fluid-storing container according to an embodiment of the present invention.
Figure 2:
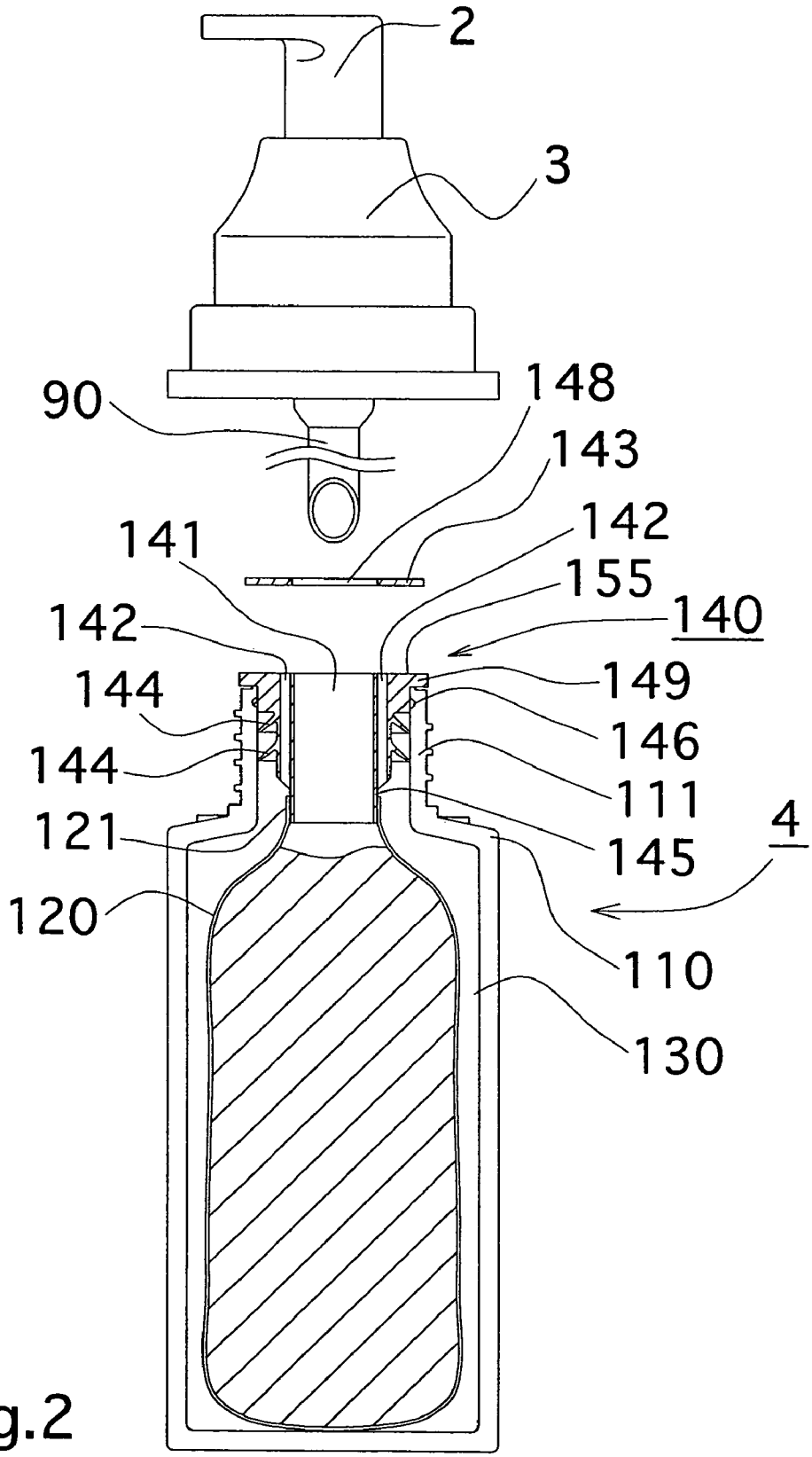
FIG. 2 is a partially sectional exploded view of the fluid-storing container according to an embodiment of the present invention.

FIG. 1 is a partially sectional view showing a relevant part of the fluid-storing container according to an embodiment of the present invention. FIG. 2 is a partially sectional exploded view of the fluid-storing container according to an embodiment of the present invention. In FIG. 1 and FIG. 2, hatching is added only to cross sections of the coupling material 140, the through-bore closing material 143 and the fluid. Additionally, a front view of a nozzle head 2 and an outer lid 3 is shown in FIG. 1 and FIG. 2.

The fluid-storing container is used as a container for beauty products for storing gels such as hair gels and cleansing gels or creams such as nourishing creams and cold creams used in the cosmetic field. Additionally, this fluid-storing container can also be used as a container for medicines, solvents or foods, etc. In this specification, high-viscosity liquids, semifluids, or gels that sol solidifies to a jelly, creams and regular liquids are all referred to as fluids. That is, a fluid can include any flowable liquid or solid which may contain gas.

This fluid-storing container comprises a fluid discharge pump 1, the nozzle head 2, the outer lid 3 and the fluid-storing portion 4 storing a fluid inside it.

As shown in FIG. 1, a suction tube 90 has a configuration of being inserted into the fluid-storing portion 4. As shown in FIG. 2, the fluid discharge pump 1, the nozzle head 2, the outer lid 3 and the fluid-storing portion can be detached from each other.

Figure 3:
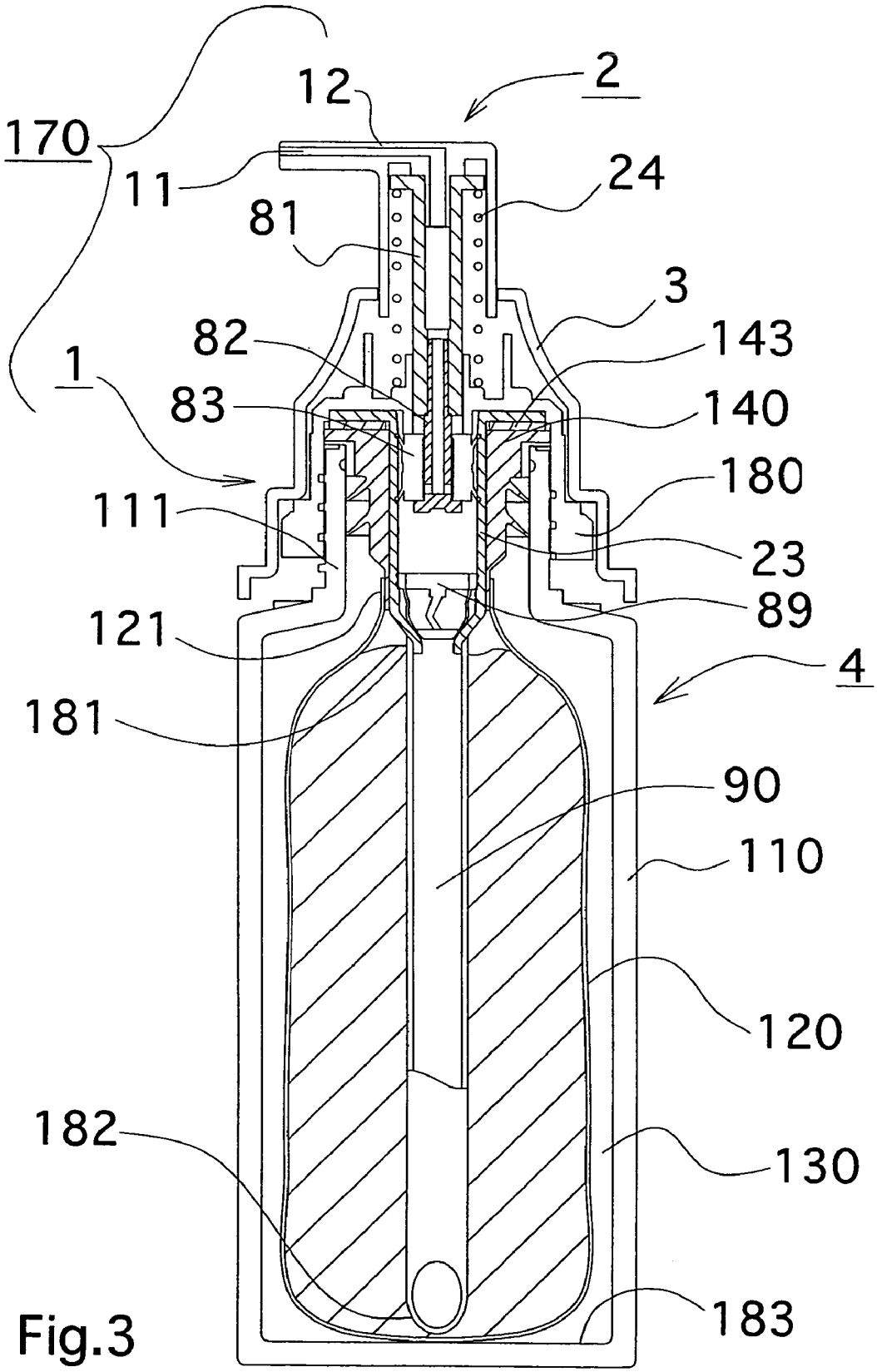
FIG. 3 is a longitudinal sectional view of the fluid-storing container according to an embodiment of the present invention, where a nozzle head is at a home position.
Figure 4:
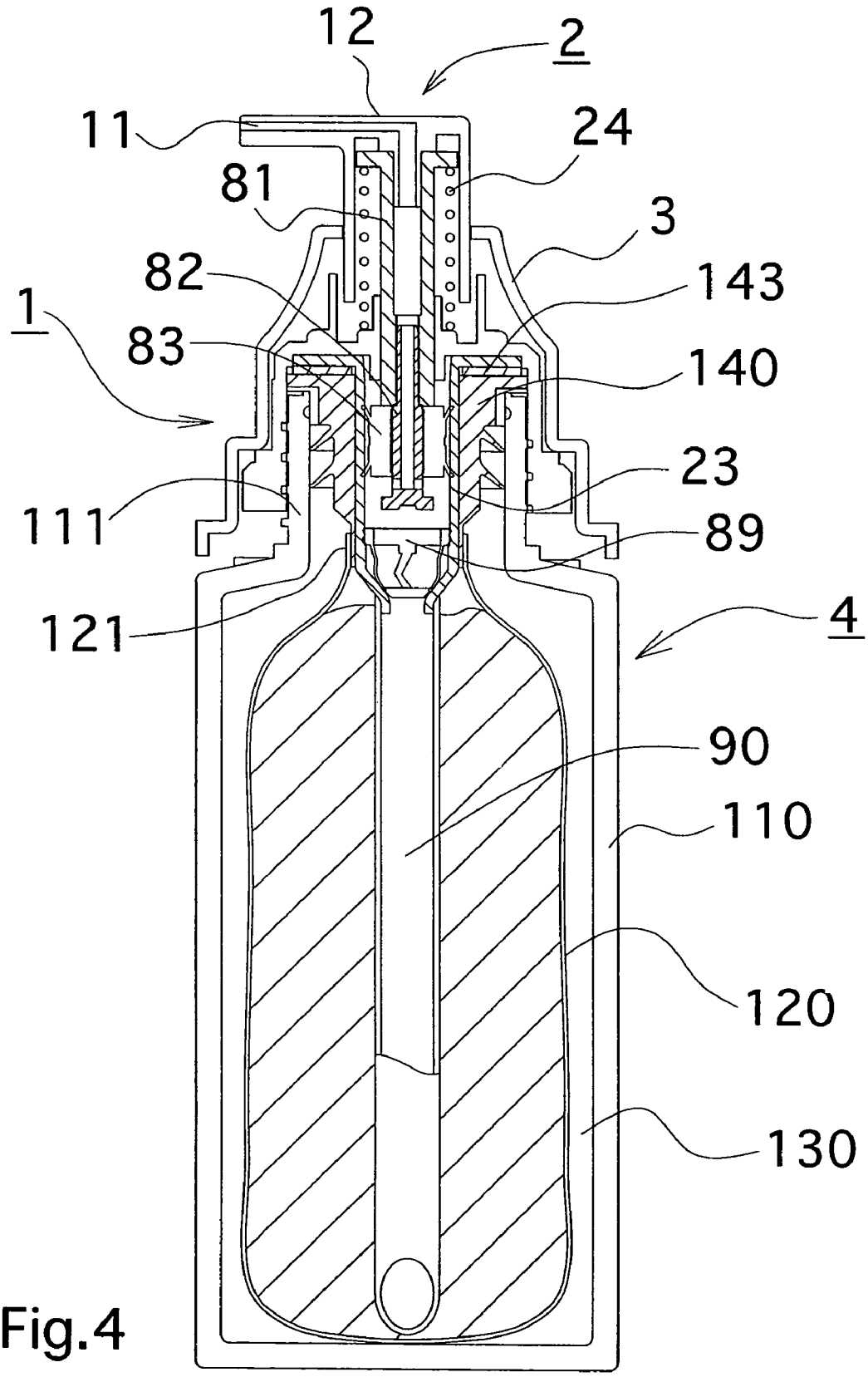
FIG. 4 is a longitudinal sectional view of the fluid-storing container according to an embodiment of the present invention, where the nozzle head is pressed with no fluid in the cylinder.
Figure 5:
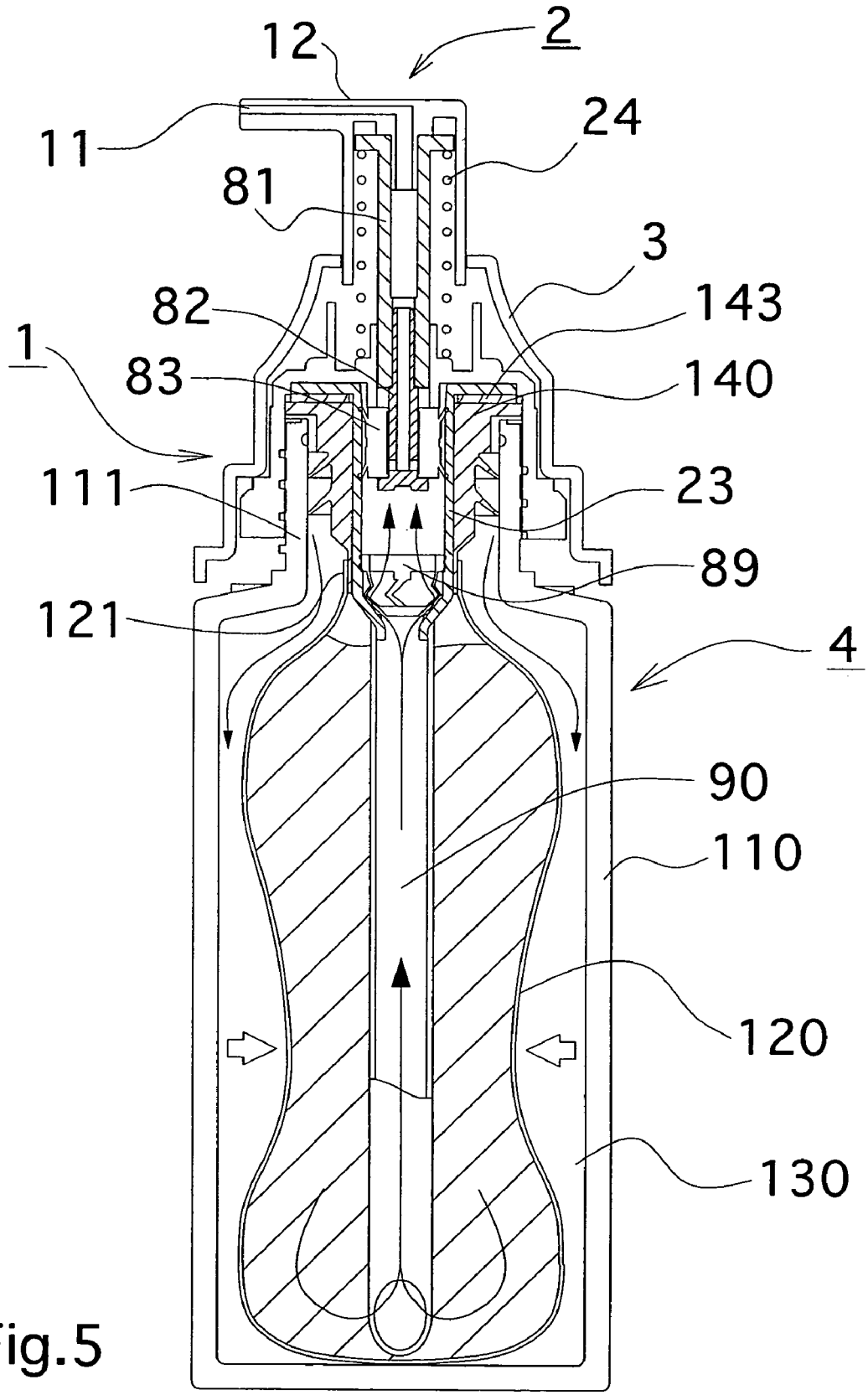
FIG. 5 is a longitudinal sectional view of the fluid-storing container according to an embodiment of the present invention, where the nozzle head is released to introduce the fluid into the cylinder.
Figure 6:
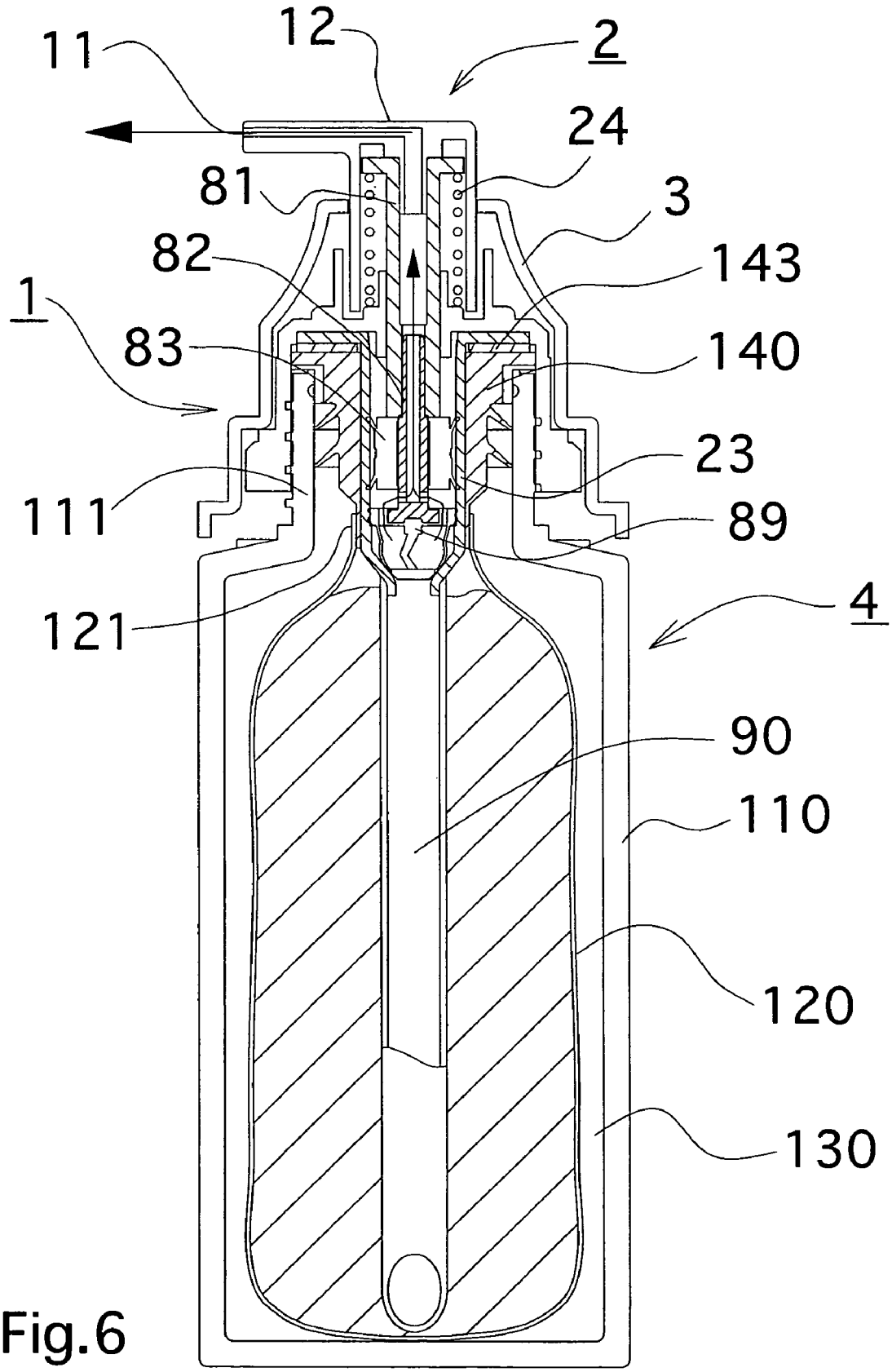
FIG. 6 is a longitudinal sectional view of the fluid-storing container according to an embodiment of the present invention, where the nozzle head is pressed to discharge the fluid therethrough.

FIGS. 3 to 6 show longitudinal sections of the fluid-storing container according to an embodiment of the present invention. Hatching is added only to cross sections of the coupling material 140, the through-bore closing material 143, the first and the second coupling tubes 81 & 82, a cylinder 23, and the fluid. Of these figures, FIG. 3 shows a position in which the fluid discharge pump is left as it is without stress applied. FIG. 4 shows a position in which the first and the second coupling tubes 81 & 82 are descending along with the piston 83 with a pressing portion 12 of the nozzle head 2 being pressed. FIG. 5 shows a position in which the first and the second coupling tubes 81 & 82 are ascending along with the piston 83 with pressure applied to the nozzle head 2 removed. FIG. 6 shows a position in which both the first and the second coupling tubes 81 & 82 have reached the bottom along with the piston 83. In the above, after the position shown in FIG. 4 (prior to the introducing of the fluid into the interior of the cylinder) but before the position shown in FIG. 5 (during the introducing of the fluid into the interior of the cylinder), the first and the second coupling tubes 81 and 82 reach the lowest position as shown in FIG. 6 without the arrows of the fluid flow, because the full strokes of the coupling tubes generate full suction power.

As shown in FIG. 3, the nozzle head 2 has a discharge portion 11 for discharging the fluid and the pressing portion 12 which is pressed when the fluid is discharged. The outer lid 3 is engaged with a screw portion formed at the top of the fluid-storing portion 4 via a screw material.

In this fluid-storing container, by reciprocating the piston in upward and downward directions by pressing the pressing portion 12 in the nozzle head 2, the fluid stored inside the fluid-storing portion 4 is discharged from the discharge portion 11 in the nozzle head 2 by the action of the fluid discharge pump 1 described in detail later. Additionally, in this specification, the upward and downward directions shown in FIG. 1 to FIG. 2 are defined as the upward and downward directions in the fluid-storing container.

The fluid-storing portion 4 of the fluid-storing container according to an embodiment of the present invention is described below. FIG. 7 is a longitudinal sectional view showing a position in which the fluid-storing portion 4 of the fluid-storing container according to an embodiment of the present invention is assembled. FIG. 8 is a longitudinal sectional view showing a position of the fluid-storing portion 4 of the fluid-storing container according to an embodiment of the present invention with the fluid filled. Hatching is added only to cross sections of the coupling material 140, the through-bore closing material 143, and the fluid in FIG. 7 and FIG. 8.

The fluid-storing portion 4 possesses an external container 110 on top of which an opening portion is formed, an internal container 120 which can be housed inside the external container 110, and a coupling material 140 set up in the opening portion 121 of the internal container, which forms an internal space 130 shielded from the outside between the internal container 120 and the external container 110 by fixing the opening portion 121 of the internal container in the vicinity of the opening portion 111 of the external container.

As shown in FIG. 5 and FIG. 6, when the volume of the internal container 120 is decreased as the fluid stored in the internal container 120 is discharged, inside the internal space 130 is momentarily depressurized. When inside the internal space 130 is depressurized, the air flows into the internal space 130 from the outside by the action of a runoff prevention mechanism described in detail later. By this action, pressure inside the internal space 130, and outside pressure and pressure inside the internal container 120 are kept constant and facilitating suction of the fluid from the internal container 120 becomes possible.

The external container 110 comprises a hard material such as synthetic resin and glass. The internal container 120 comprises a flexible bag body having the opening portion 121. By using this double configuration, the internal container 120 changes shape as the volume of the fluid is decreased while maintaining an external shape, enabling to facilitate suction of the fluid.

When this fluid-storing portion 4 is assembled, as shown in FIG. 7, the first engaging portion 145 of the coupling material 140 is inserted in the opening portion 121 of the internal container; this internal container 120 is inserted inside the external container 110 through the opening portion 111 of the external container; the second engaging portion 146 of the coupling material 140 engaging with the internal container 120 is engaged with the vicinity of the opening portion 111 of the external container. In this way, the internal container 120 and the coupling material 140 are fixed liquidtightly. By this coupling material 140, the internal space 130 leading to the outside only through the through-bore 142 described later is formed between the external container 110 and the internal container 120. Additionally, when the through-bore closing material 143 is placed on top of the coupling material 140 fixed in the opening portion 111 of the external container, the through-bore 142 is closed by this through-bore closing material 143.

The internal container 120 may be made of any suitable flexible materials such as a thin film of any suitable resin including, but not limited to, polyethylene resin and vinyl resin, because the internal container is protected by the external container, and further, due to the function of the coupling material, even if the internal container is broken, the fluid would not come out from the external container. Further, the opening portion of the internal container 120 can be fixed to the first engaging portion 145 of the coupling material 140 by methods using an adhesive, screw threads, press-fitting, welding, etc. Welding may be preferable because the internal container is thin and because both the coupling material and the internal container may be made of a resin.

As shown in FIG. 8, when the fluid is filled inside the fluid-storing portion 4, the fluid discharge pump 1, the nozzle head 2 and the outer lid 3 are detached from the fluid-storing portion 4, and the through-bore closing material 143 placed on the coupling material 143 is removed. In this way, the air inside the internal space 130 formed between the external container 110 and the internal container 120 can flow outside through the through-bore 142. Consequently, it becomes possible to prevent pressure increase caused by decrease in the volume of the internal space 120 with volume increase in the internal container 120 when the fluid is filled.

Figure 9:
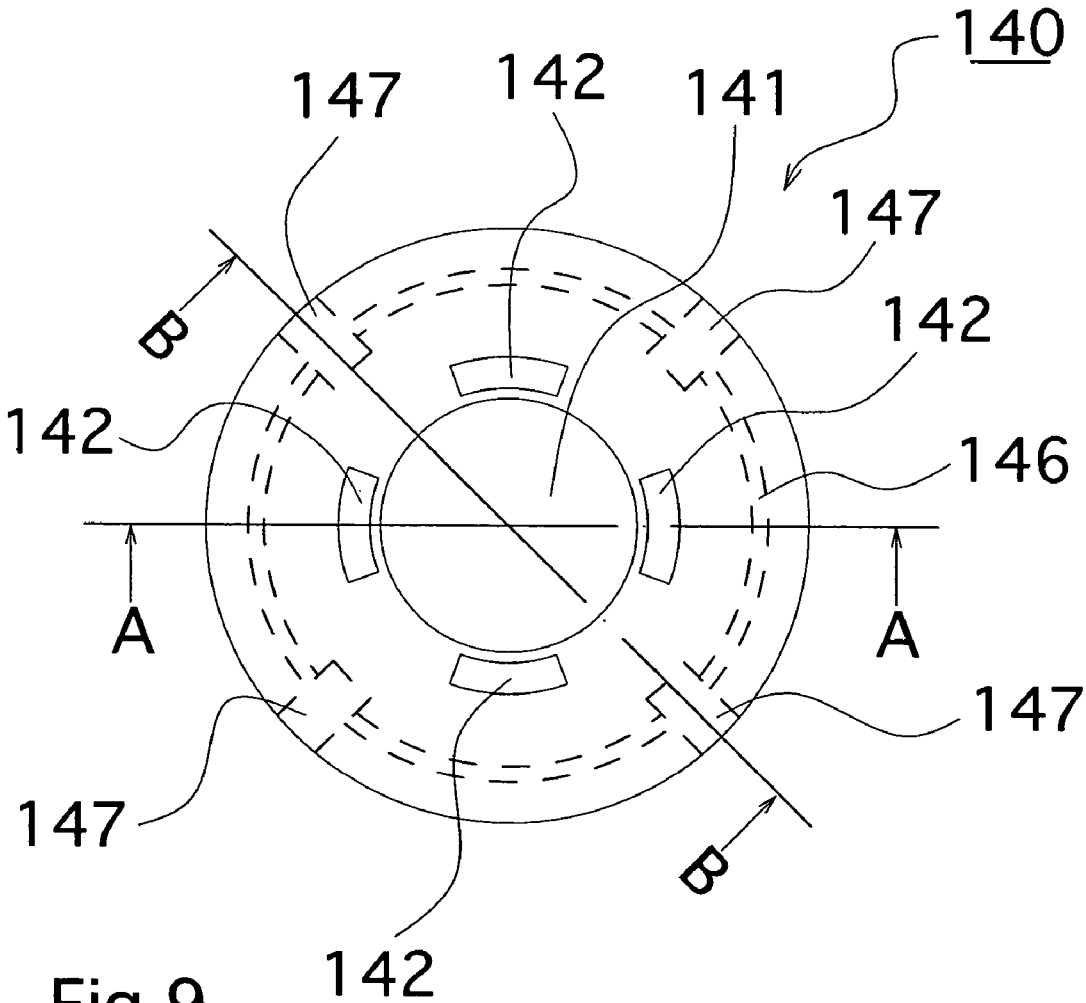
FIG. 9 is a plan view showing the coupling material of the fluid-storing portion of the fluid-storing container according to an embodiment of the present invention.
Figure 10:
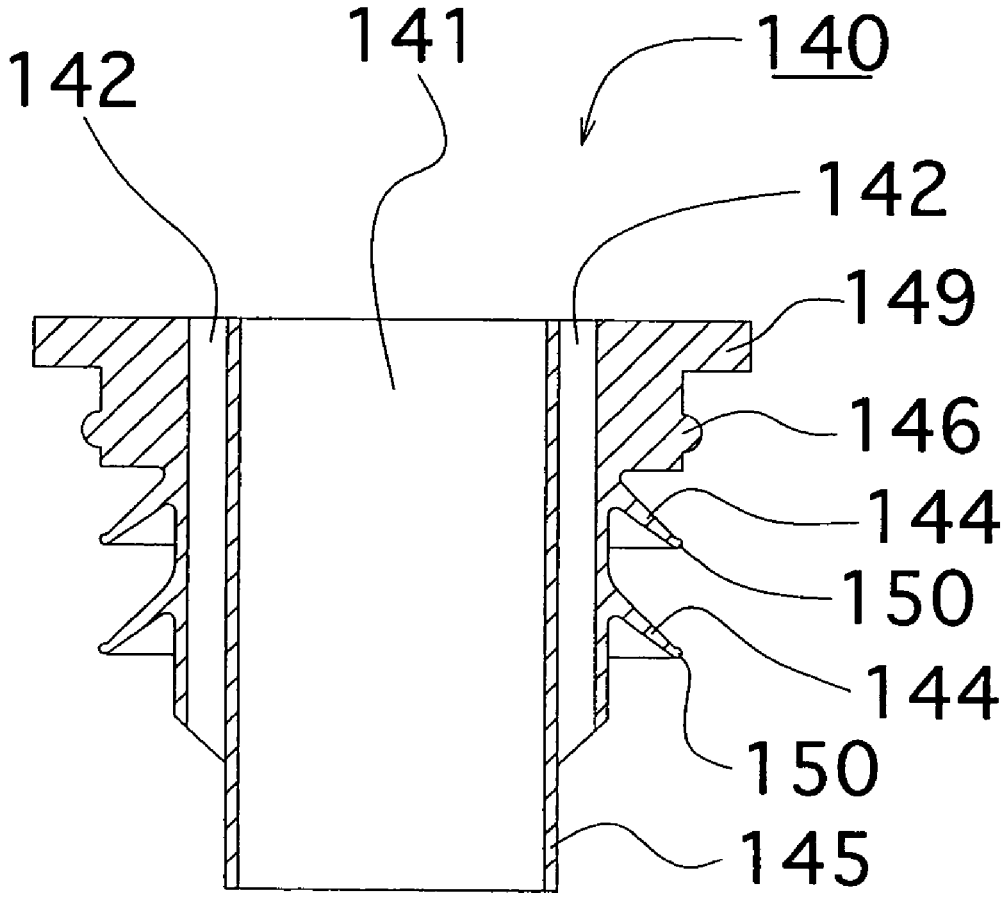
FIG. 10 is an A—A cross section in dedicated in FIG. 9.

FIG. 9 is a plan view of the coupling material 140 of the fluid-storing portion 4 of the fluid-storing container according to an embodiment of the present invention. FIG. 10 is an A—A cross sectional view of FIG. 9. FIG. 11 is a B—B cross sectional view of the FIG. 9. FIG. 12 is a backside view of the coupling material 140 of the fluid-storing portion 4 of the fluid-storing container according to an embodiment of the present invention. FIG. 13(*a*) is a plan view of the through-bore closing material 143 of the fluid-storing portion 4 of the fluid-storing container according to an embodiment of the present invention. FIG. 13(*b*) is a cross sectional view of the through-bore closing material 143 of the fluid-storing portion 4 of the fluid-storing container according to an embodiment of the present invention.

The through-bore closing material 143 may be made of a resin including, but not limited to, polypropylene and polyethylene (either hard or soft), or silicon rubber.

As shown in FIGS. 9 to 12, the coupling material 140 is a nearly cylinder-shaped and possesses the first engaging portion 145 which engages with the opening portion 121 of the internal container, the second engaging portion 146 which engages with the opening portion 111 of the external container, and a hollow portion 141 which enables the fluid stored inside the internal container to flow outside via the opening portion 111 of the external container.

Additionally, in the coupling material 140, the through-bore 142 passing through the outside and the internal space 120 is formed. This through-bore 142 is closed by placing the through-bore closing material 143 on top of the coupling material 140. With such a configuration having the through-bore closing material 143, preventing the fluid from flowing outside from the internal space 120 becomes possible. When the fluid is newly filled in the internal container 120, the through-bore closing material is removed. This makes it possible to prevent pressure increase inside the internal space with volume increase in the internal container 120. Additionally, because this through-bore closing material 143 has a hollow portion 148 leading to the hollow portion 141 of the coupling material, discharging the fluid from the internal container 120 becomes possible.

The coupling material 140 further possesses the runoff prevention mechanism. As shown in FIG. 10 and FIG. 11, this runoff prevention mechanism comprises two leakproof portions 144 which are juxtaposed above and below and a groove portion 147 formed on top of the two leakproof portions 144.

The leakproof portions 144 have an umbrella shape opening out toward an internal direction of the external container 110; their maximum outer diameter portions contact the opening portion 111 of the external container 110. With this configuration, if the fluid attempts to flow out from inside the internal space 130, flowing out of the fluid from the internal space 130 is prevented with the maximum outer diameter portions of the leakproof portions 144 open toward a direction which they contact the inner surface of the opening portion 111 of the external container.

Additionally, the leakproof portions 144 have flexibility. Because of this, when pressure is applied to the leakproof portions 144 from the outside due to pressure decrease inside the internal space 130, the leakproof portions 144 close in a direction that their maximum outer diameter portions become small. Consequently, the leakproof portions 144 separate from the inner surface of the opening portion 111 of the external container, enabling the air to pass through from outside to the internal space 130.

With the configuration described above, when the fluid stored leaks to the internal space 130 due to damage made to the internal container, etc., leaking of the fluid to outside the external container can be prevented. Additionally, the number of the leakproof portions 144 described above is not limited to two; it can be one or more.

The coupling member may be made of any suitable elastic material such as a resin, rubber, composite, etc. In order to perform the above described operation of the coupling member effectively, an elastic material including, but not limited to, a resin such as polypropylene and polyethylene, a resin containing a rubber material such as silicon rubber, and the like can preferably be used. Hardness of the member can be adjusted by adjusting a ratio of a hard resin to a soft resin. In an embodiment, the leakproof portion can be made of a more flexible material than that for the remaining portion of the coupling member, in order to facilitate preventing the fluid from leaking but permitting air to be introduced.

With the coupling material configuration described above, when the fluid stored leaks to the internal space 130 due to damage made to the internal container, etc., leaking of the fluid to outside the external container can be prevented because the coupling material possesses the leakproof portions 144. Additionally, because providing the air hole in the external container is not necessary, containers available on the market, e.g. glass bottles, aluminum cans, etc. can be used as the external container 110 without any modification. Any containers capable of housing the internal container 120 can be used.

Figure 14:
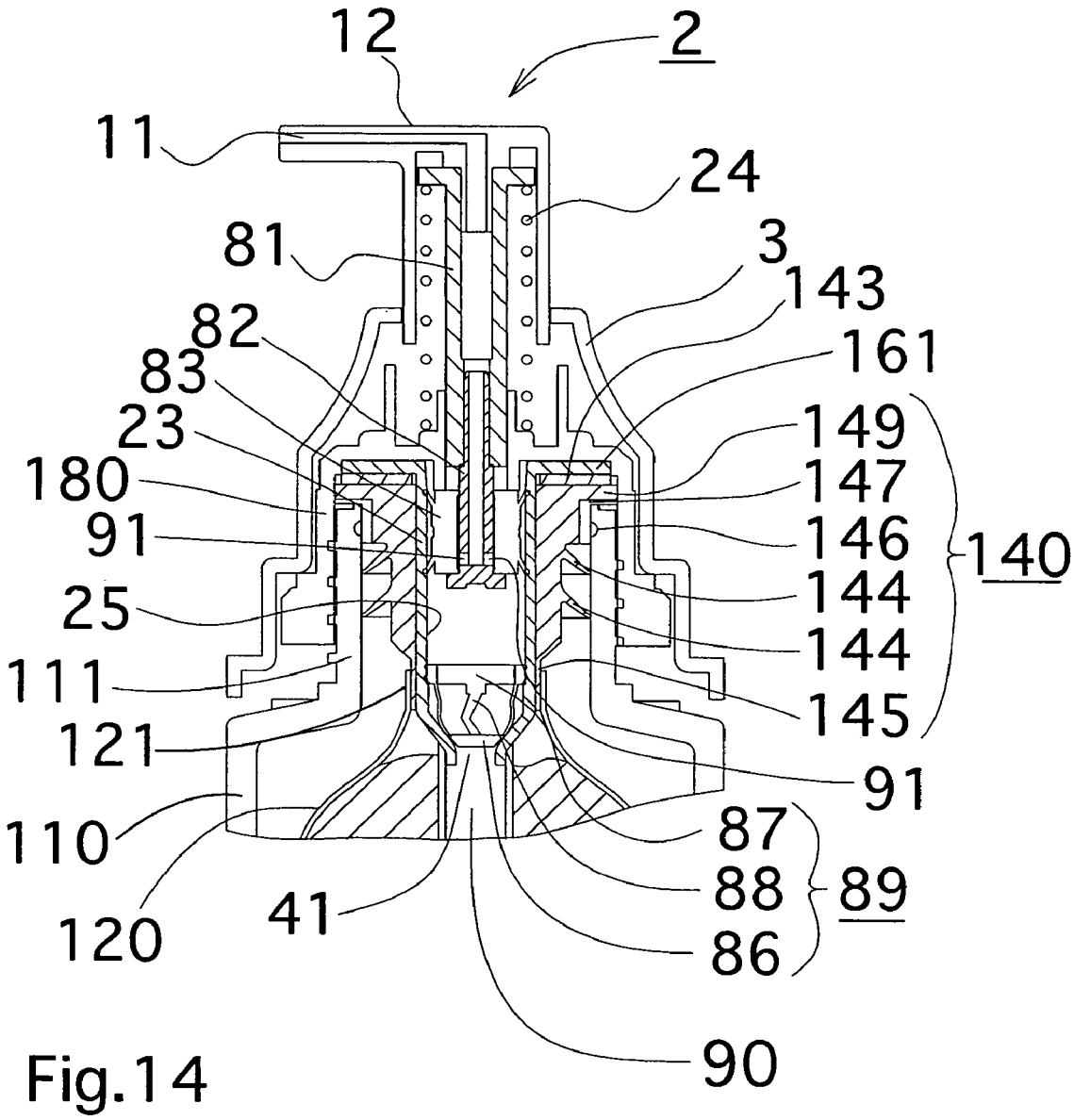
FIG. 14 is a longitudinal sectional view showing a relevant part of the fluid discharge pump of the fluid-storing container according to an embodiment of the present invention, where the nozzle head is at a home potion.
Figure 15:
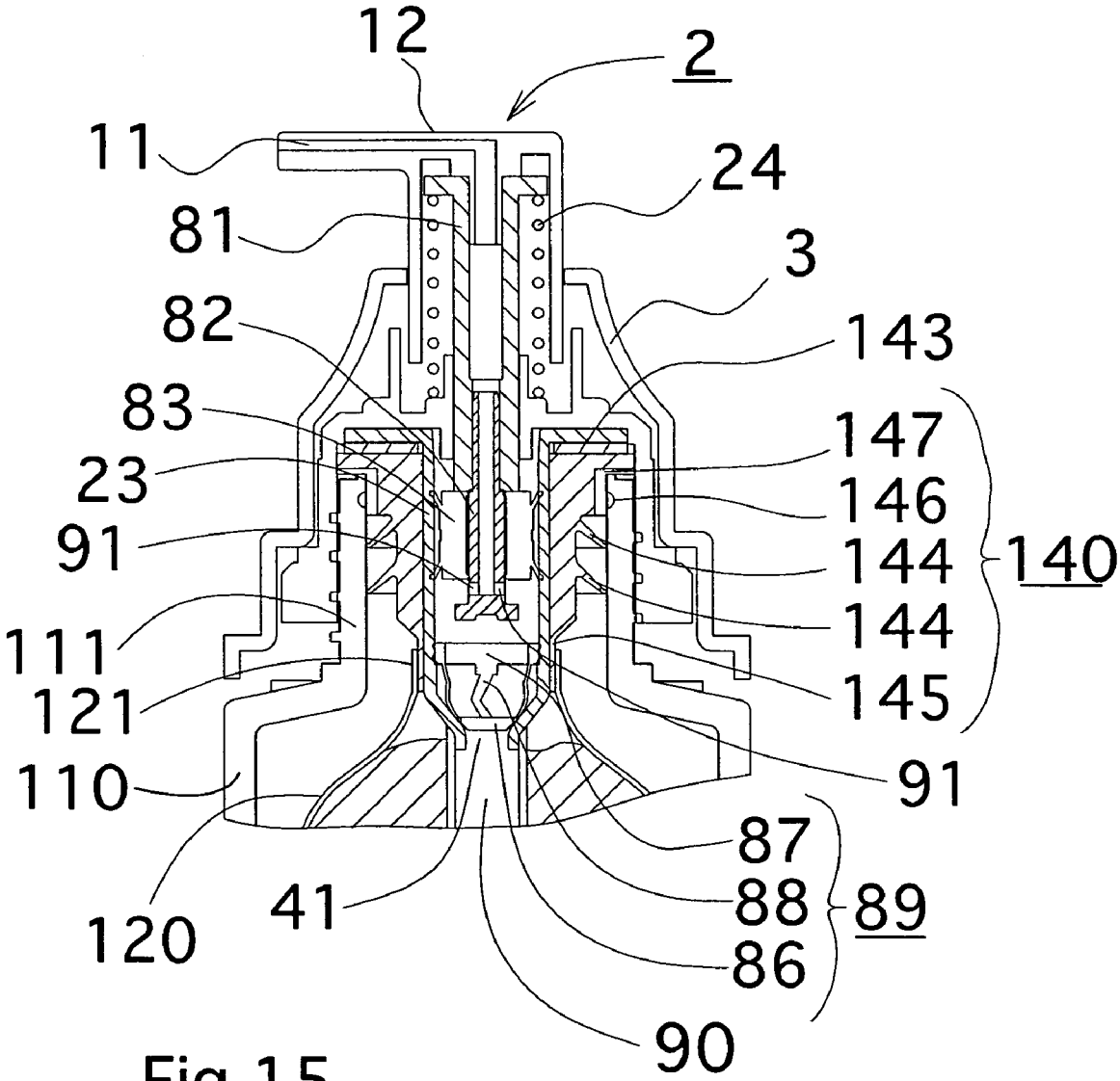
FIG. 15 is a longitudinal sectional view showing a relevant part of the fluid discharge pump of the fluid-storing container according to an embodiment of the present invention, where the nozzle head is pressed without a fluid in a cylinder.
Figure 16:
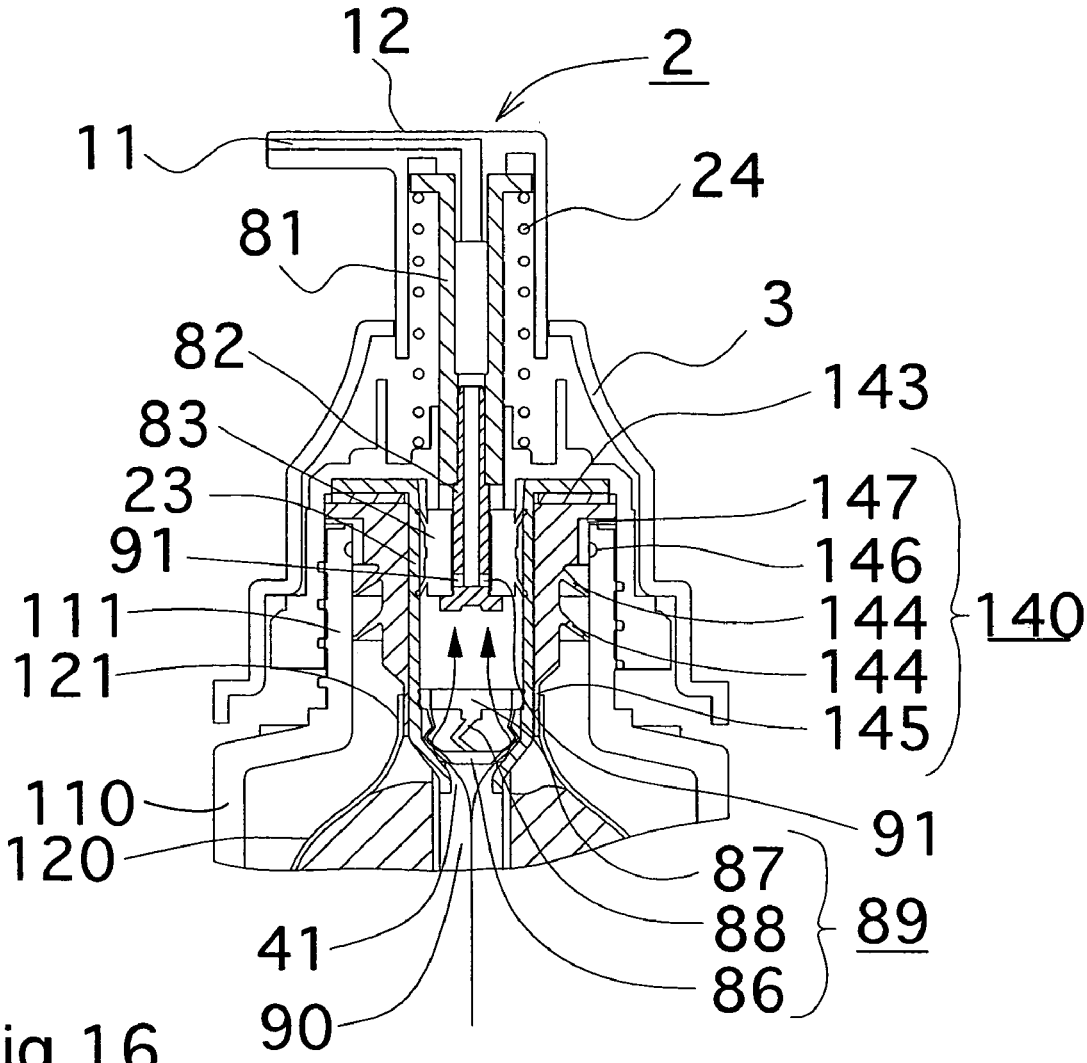
FIG. 16 is a longitudinal sectional view showing a relevant part of the fluid discharge pump of the fluid-storing container according to an embodiment of the present invention, where the nozzle head is released to introduce the fluid into the cylinder.
Figure 17:
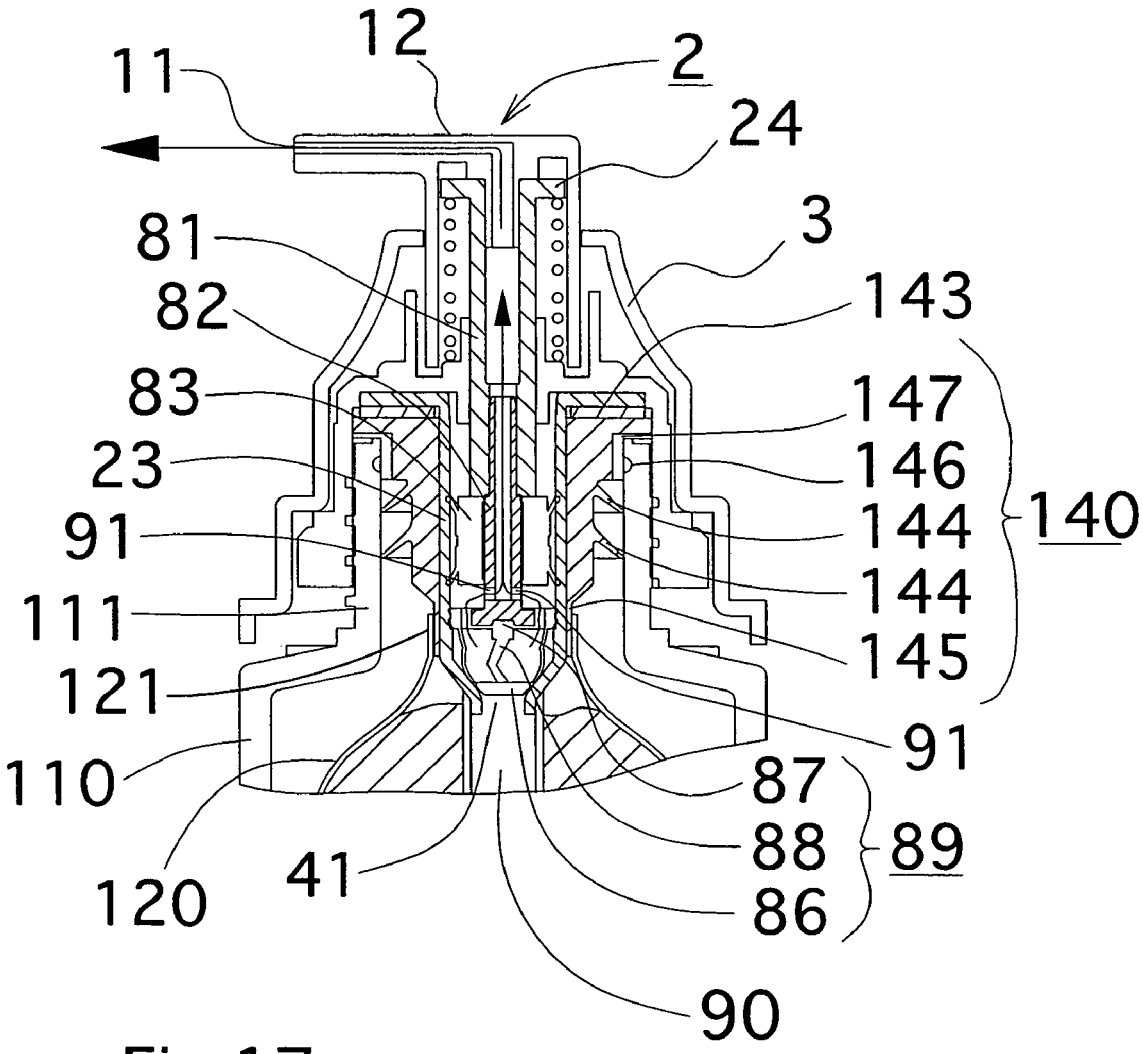
FIG. 17 is a longitudinal sectional view showing a relevant part of the fluid discharge pump of the fluid-storing container according to an embodiment of the present invention, where the nozzle head is pressed to discharge the fluid therethrough.

A configuration of the fluid discharge pump 1 is described below. FIGS. 14 to 17 show longitudinal sections of the fluid discharge pump 1 used for the fluid-storing container according to the aforesaid embodiment of the present invention together with the nozzle head 2. Of these figures, FIG. 14 shows a position in which the fluid discharge pump is left as it is without stress applied. FIG. 15 shows a position in which the first and the second coupling tubes 81 & 82 are descending along with the piston 83 with a pressing portion 12 in the nozzle head 2 being pressed. FIG. 16 shows a position in which the first and the second coupling tubes 81 & 82 are ascending along with the piston 83 with pressure applied to the nozzle head 2 removed. FIG. 17 shows a position in which both the first and the second coupling tubes 81 & 82 have reached the bottom along with the piston 83. In the above, after the position shown in FIG. 15 (prior to the introducing of the fluid into the interior of the cylinder) but before the position shown in FIG. 16 (during the introducing of the fluid into the interior of the cylinder), the first and the second coupling tubes 81 and 82 reach the lowest position as shown in FIG. 17 without the arrows of the fluid flow, because the full strokes of the coupling tubes generate full suction power. Hatching is added only to cross sections of the coupling material 140, the through-bore closing material 143, the first and the second coupling tubes 81 & 82, the cylinder 23 and the fluid in FIGS. 14 to 17.

The fluid discharge pump 1 is set up inside the nearly cylinder-shaped coupling 140. With this configuration, while the entire fluid-storing container is downsized, the fluid discharge pump 1 can be supported stably.

The fluid discharge pump 1 possesses the cylinder 23, the piston 83 which can reciprocate inside the cylinder 23, the first and the second hollow coupling tube 81 & 82 which are coupled and fixed one another and together form a coupling tube for sending down the piston 83 by transmitting pressure applied to the nozzle head 2 to the piston 83 by coupling the nozzle head 2 and the piston 83, a coil spring 24 set up at the periphery of the first and the second coupling tubes 81 & 82 for giving momentum to the piston 83 in an ascending direction, the first valve mechanism for pumping the fluid stored inside the internal container 120 into the cylinder 23 with ascending of the piston 83, the second valve mechanism opening/closing an opening portion 91 for letting the fluid flow into the cylinder 23 out to the nozzle head 2 via inside the first and the second coupling tubes 81 & 82 with descending of the piston 83, and the suction tube 90 which guides the fluid inside the internal container into the cylinder 23.

The above-mentioned piston 83 comprises a resin such as silicon rubber, polypropylene and polyethylene. For the coil spring 24, a metal coil spring can be used for obtaining strong momentum.

By positioning the tip of the suction tube 90 in the vicinity of the base end surface of the external container 110 and the internal container 120, the fluid leaking into the internal space 130 due to damage made to the internal container 120, etc. can be discharged efficiently.

The above-mentioned first valve mechanism is used for closing the opening portion 41 leading to the suction tube 90 engaged with the vicinity of the lower end of the cylinder 23 when inside the cylinder 23 is pressurized, and for opening the opening 41 when inside the cylinder 23 is depressurized.

The first valve mechanism possesses a tapered portion 86 which is tapered by the same angle as the tapered inner surface of the lower end portion of the cylinder 23, and a resin valve body 89 having four coupling portions 88 which couple the tapered portion 86 and the supporting portion 87. In the first valve mechanism, as shown in FIG. 15, the opening portion 41 is closed with the tapered portion 86 of the valve body 89 contacting the tapered inner surface of the lower end portion of the cylinder 23 when inside the cylinder 23 is pressurized. When inside the cylinder 23 is depressurized, the opening portion 41 is opened with the tapered portion of the valve body 86 separating from the inner surface of the lower end portion of the cylinder 23 as shown in FIG. 16.

The above-mentioned second valve mechanism is used for opening a flow path passing through inside the first and the second coupling tubes 81 & 82 and inside the cylinder 23 by opening the opening portion 91 made below the cylinder-shaped portion of the second coupling tube 82 when the nozzle head 2 is pressed, and for closing the flow path passing through inside the first and the second coupling tubes 81 & 82 and inside the cylinder 23 by closing the opening portion 91 when pressure applied to the nozzle head 2 is removed.

The piston 83 inside the cylinder 23 is set up so as to be able to slide on the second coupling tube 82 between a joined portion with the first coupling tube in the second coupling tube 82 and the lower end portion of the second coupling tube 82. As shown in FIGS. 4, 6, 15 and 17, in a position in which the top of the piston 23 contacts a portion joined with the first coupling tube 81 in the second coupling tube, a flow path leading to inside the first and the second coupling tubes 81 & 82 from inside the cylinder 23 is formed. As shown in FIGS. 3, 5, 14 and 16, in a position in which the lower end portion of the piston 83 contacts the lower end portion of the second coupling tube, a flow path leading to inside the first and the second coupling tubes 81 & 82 from inside the cylinder 23 is closed.

Fluid discharge motions by the fluid discharge container possessing the above-mentioned fluid discharge pump 1 are described below.

In the initial position, as shown in FIGS. 3 and 14, momentum is given to the first and the second coupling tubes 81 & 82 coupled each other in the upward direction by the action of the coil spring 24, and the lower end portion of the second coupling tube 82 contacts the lower end portion of the piston 83. Consequently, a flow path leading to inside the first and the second coupling tubes 81 & 82 from inside the cylinder 23 is closed. Additionally, by the action of the coupling portion 88 in the valve body 89, the tapered portion 86 of the valve body 89 contacts the tapered inner surface of the lower end portion of the cylinder 23, closing the opening portion 41.

In this position, if the pressing portion 12 in the nozzle head 2 is pressed, the first and the second coupling tubes 81 & 82 first descend relatively to the piston 83 as shown in FIG. 4 and FIG. 15. By this motion, the lower end portion of the second coupling tube 82 and the lower end portion of the piston 83 separate. Consequently, a flow path leading to inside the first and the second coupling tubes 81 & 82 from inside the cylinder 23 via the opening portion 91 is formed.

If the pressing portion 12 in the nozzle head 2 is pressed further, inside the cylinder 23 is pressurized as shown in FIG. 6 and FIG. 17. Consequently, the pressurized fluid inside the cylinder 23 flows out to the discharge portion 11 in the nozzle head 2 via the opening portion 91 and the first and the second coupling tubes 81 & 82 which are hollow and is discharged from the discharge portion 11.

After the piston 83 descends to the stroke lower end and if pressure applied to the nozzle head 2 is removed, the first and the second coupling tubes 81 & 82 ascend relatively to the piston 83 by the action of the coil spring 24. By this motion, the lower end portion of the second coupling tube 82 contacts the lower end portion of the piston 83. Consequently, a flow path leading to inside the first and the second coupling tubes 81 & 82 from inside the cylinder 23 is closed again.

Thereafter, by the action of the coil spring 24, the nozzle head 2 and the first and the second coupling tubes 81 & 82 ascend in one. Because inside the cylinder 23 is depressurized then, the opening portion 41 is opened with the tapered portion 86 of the valve body 89 separating from the tapered inner surface of the lower end portion of the cylinder 23. The fluid flows into the cylinder 23 from the internal container 120 via the suction tube 90. If moving up to the top of the elevating length, the piston 83 stops its ascending motion.

By repeating the above-mentioned motions, discharging the fluid stored inside the fluid-storing portion 4 becomes possible.

With this configuration of the fluid discharge pump, back flow of the air from the outside into the internal container 120 can be prevented. Consequently, contacting of the fluid stored with the air can be prevented. Decaying the fluid stored thus can be prevented.

The configuration of the fluid discharge pump is not limited to the above-mentioned; any configuration having a feature capable of discharging the fluid inside the container can be used.

Figure 18:
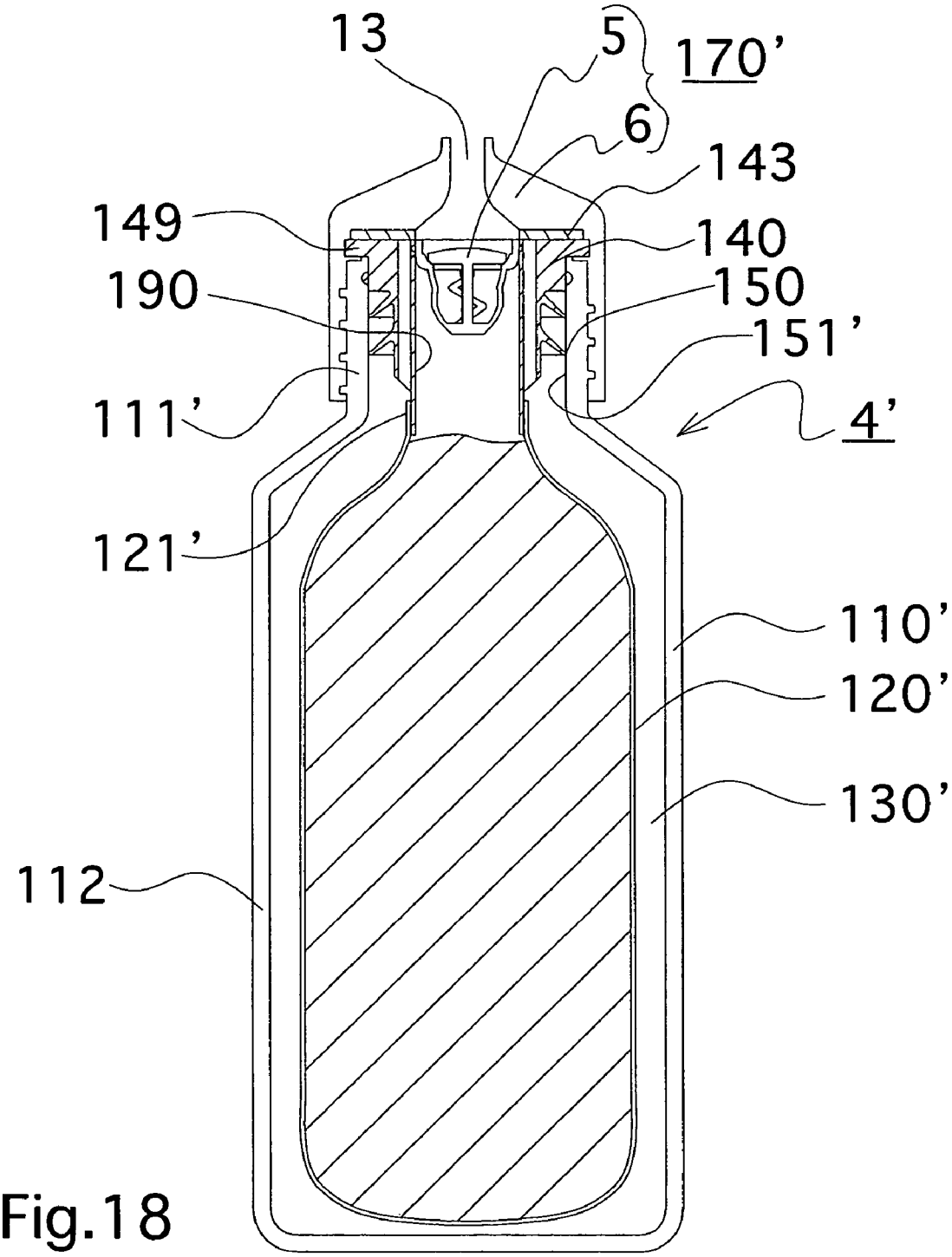
FIG. 18 is a longitudinal sectional view of the fluid-storing container according to an embodiment of the present invention, where no pressure is applied.
Figure 19:
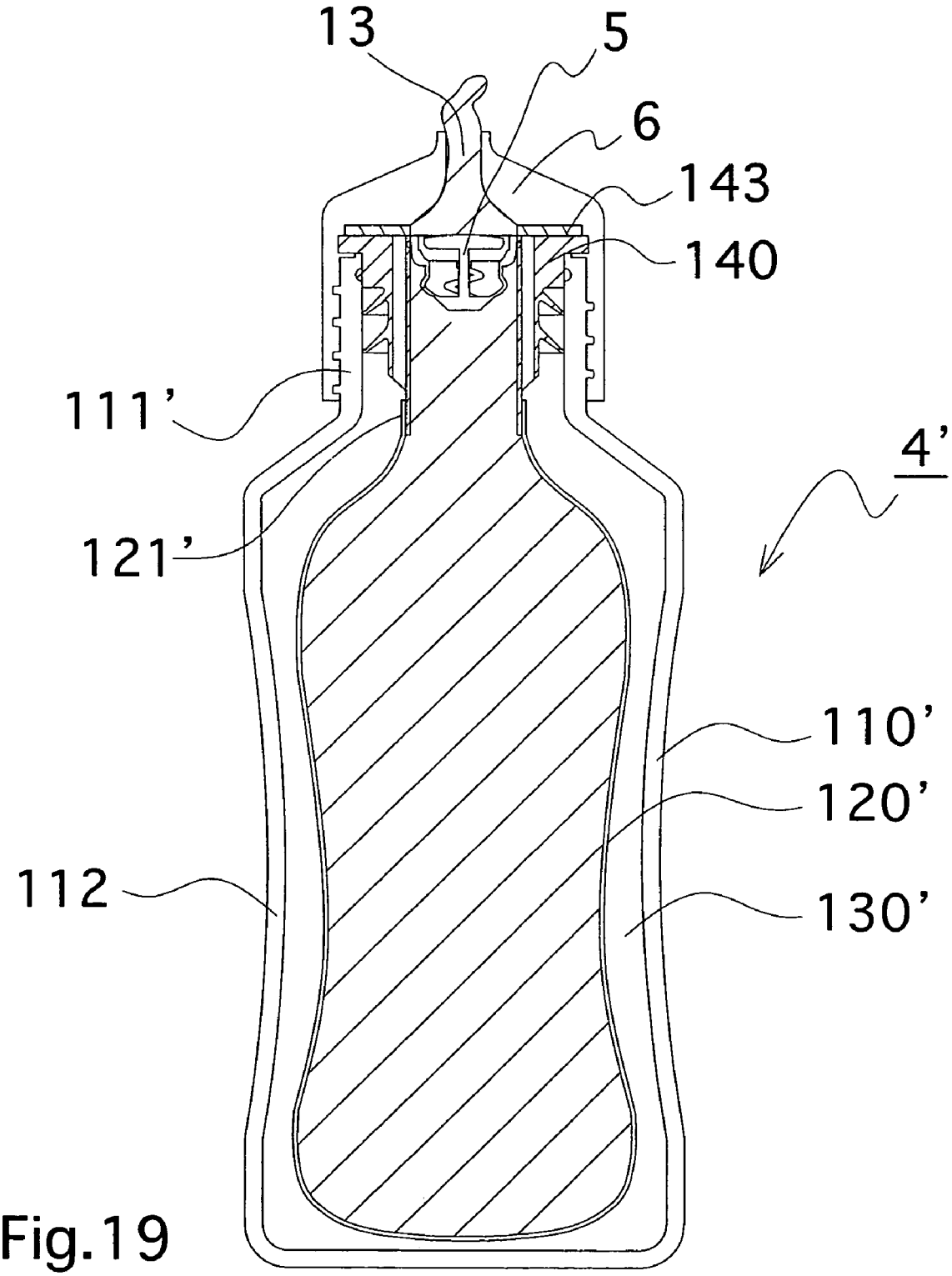
FIG. 19 is a longitudinal sectional view of the fluid-storing container according to an embodiment of the present invention, where pressure is applied to discharge the fluid from the discharge portion.
Figure 20:
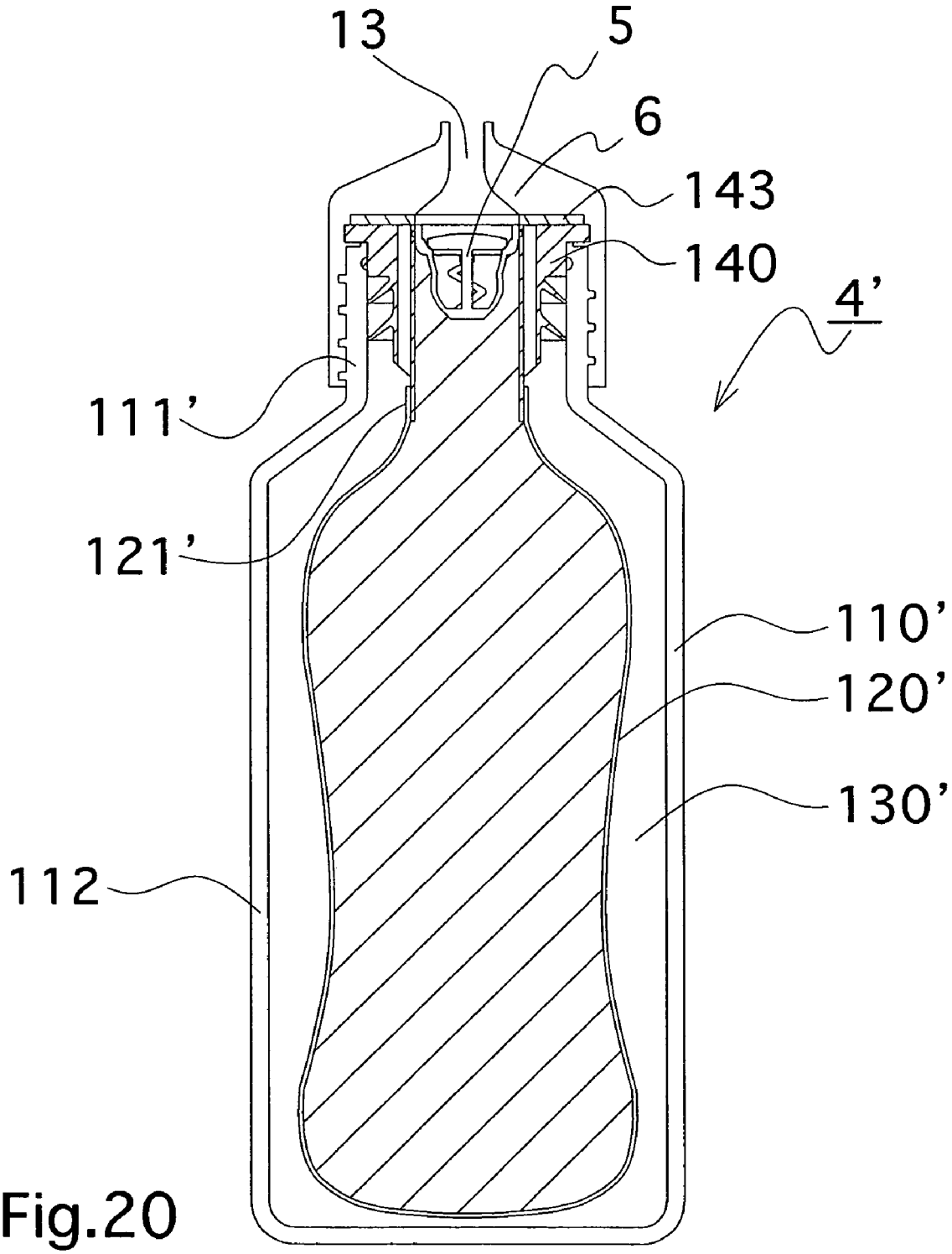
FIG. 20 is a longitudinal sectional view of the fluid-storing container according to an embodiment of the present invention, where pressure is released.

A second embodiment of the present invention is described below. However, the present invention should not be limited to the embodiment and can be applied to any suitable tube type containers. FIGS. 18 to 20 are longitudinal sections showing the second embodiment of the fluid-storing container according to the present invention. Of these figures, FIG. 18 shows a position in which the fluid-storing container is left as it is without stress applied; FIG. 19 shows a position in which the fluid inside the fluid-storing portion 4 is being discharged with the body portion in the fluid-storing portion pressed; FIG. 20 shows a position in which pressure applied to the body in the fluid-storing portion is removed. Hatching is added only to cross sections of the coupling material 140, the through-bore material 143 and the fluid in FIGS. 18 to 20.

The second embodiment of the fluid-storing container according to the present invention differs from the first embodiment in a point that the fluid is discharged by pressing the body portion 112 of the fluid-storing portion, whereas the fluid is discharged by pressing the fluid discharge pump 1 in the first embodiment of the fluid-storing container according to the present invention. Additionally, if the same materials used in the first embodiment are used in the second embodiment as well, the same symbols are used and detailed descriptions are omitted.

This fluid-storing container comprises the fluid-storing portion 4 having the same features and configuration as the first embodiment, a valve mechanism 5 and a discharge material 6.

As shown in FIG. 18, the valve mechanism 5 is engaged with the hollow portion 141 of the coupling material 140 in the fluid-storing portion 4. Additionally, the discharge material 6 is engaged with a screw portion formed at the top of the fluid-storing portion 4 via a screw material. The fluid-storing portion 4, the valve mechanism 5 and the discharge material 6 can be detached from each other.

In this fluid-storing container, when pressure is applied to the fluid stored inside the internal container 120 by pressing the body portion 112 in the fluid-storing portion 4, the fluid stored inside the fluid-storing portion 4 is discharged from a discharge port 13 in the discharge material 6. When the pressure applied to the body portion 112 in the fluid-storing portion 4 is removed, the discharge port 13 is closed by the action of a valve mechanism described in detail later, preventing back flow of the air.

As shown in FIG. 19, when the volume of the internal container 120 is decreased with the fluid stored inside the internal container 120 discharged, the internal space 130 is momentarily depressurized and pressure is applied in a direction toward the internal space 130 from the outside. Consequently, in the same manner as in the first embodiment, the air flows into the internal space 130 from the outside by the action of the runoff prevention mechanism. By this mechanism, pressure inside the internal space 130, and outside pressure and pressure inside the internal container 120 are kept constant, and facilitating suction of the fluid from the internal container 120 becomes possible.

When the fluid is filled into the fluid-storing portion 4, as shown in FIG. 4, by separating the fluid-storing portion 4, the valve mechanism 5 and the coupling body 6, and by removing the through-bore closing material 14 placed on the coupling material 143 and the valve mechanism 5, it is possible to let the air inside the internal space 130 formed between the external container 110 and the internal container 120 outside through the through-bore. This prevents pressure increase resulted from decrease in the volume of the internal space as the volume of the internal container 120 increases when the fluid is filled.

Figure 21:
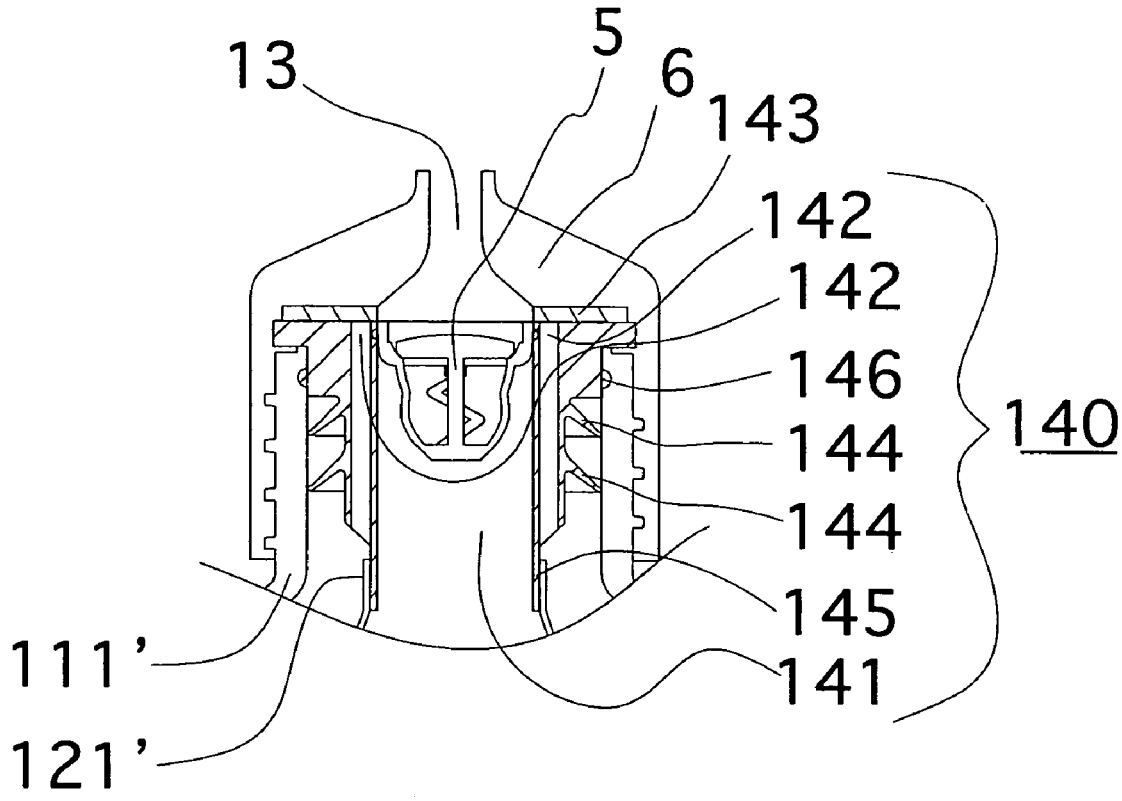
FIG. 21 is longitudinal sectional view showing a vicinity of the discharge portion of the fluid-storing container at a home position according to an embodiment of the present invention.
Figure 22:
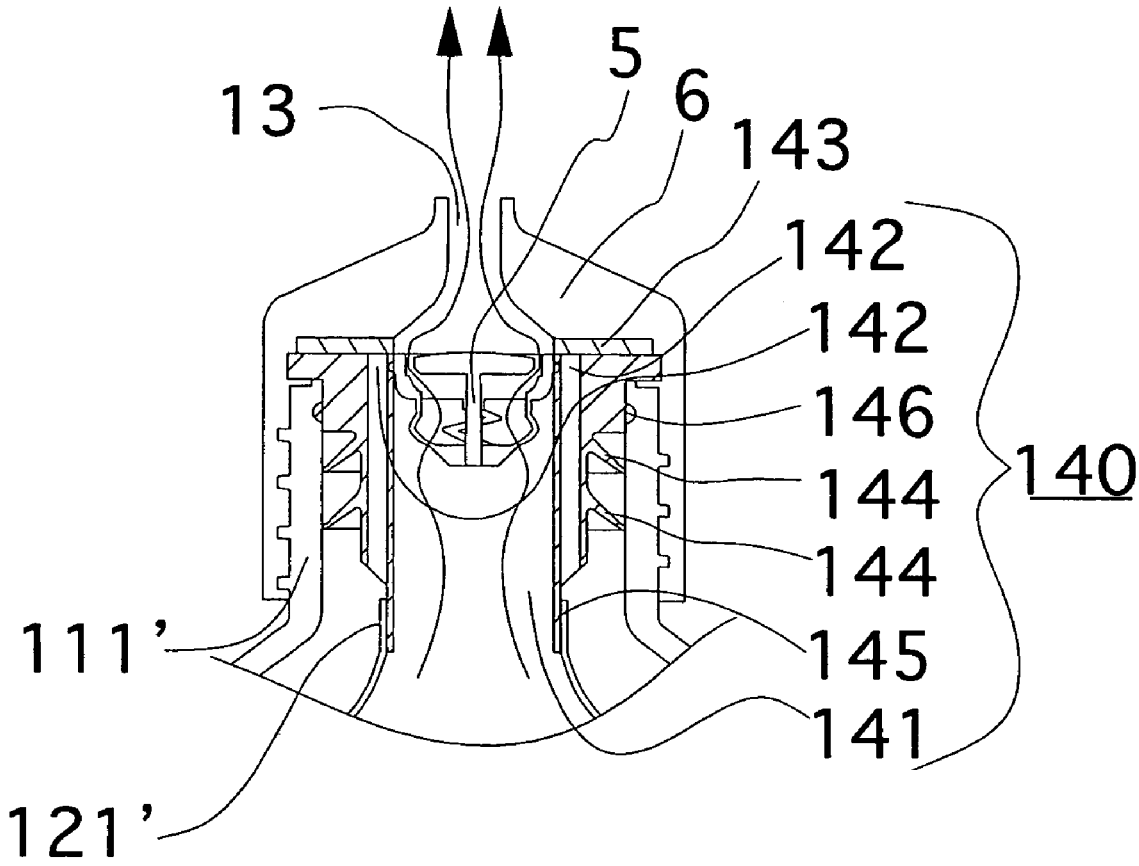
FIG. 22 is longitudinal sectional view showing a vicinity of the discharge portion of the fluid-storing container when pressure is applied at a home position according to an embodiment of the present invention.

A configuration of the valve mechanism 5 is described below. FIG. 21 and FIG. 22 are longitudinal sections showing the vicinity of the discharge portion of the fluid-storing container in a position in which the valve mechanism used for the fluid-storing container according to the present invention is engaged. Of these figures, FIG. 21 shows a position in which the fluid-storing container is left as it is without stress applied; FIG. 22 shows a position in which the fluid inside the fluid-storing container is being discharged with the body portion 112 in the fluid-storing container being pressed. Hatching is added only to cross sections of the coupling material 140 and the through-bore closing material 143 in FIG. 21 and FIG. 22.

Figure 23A:
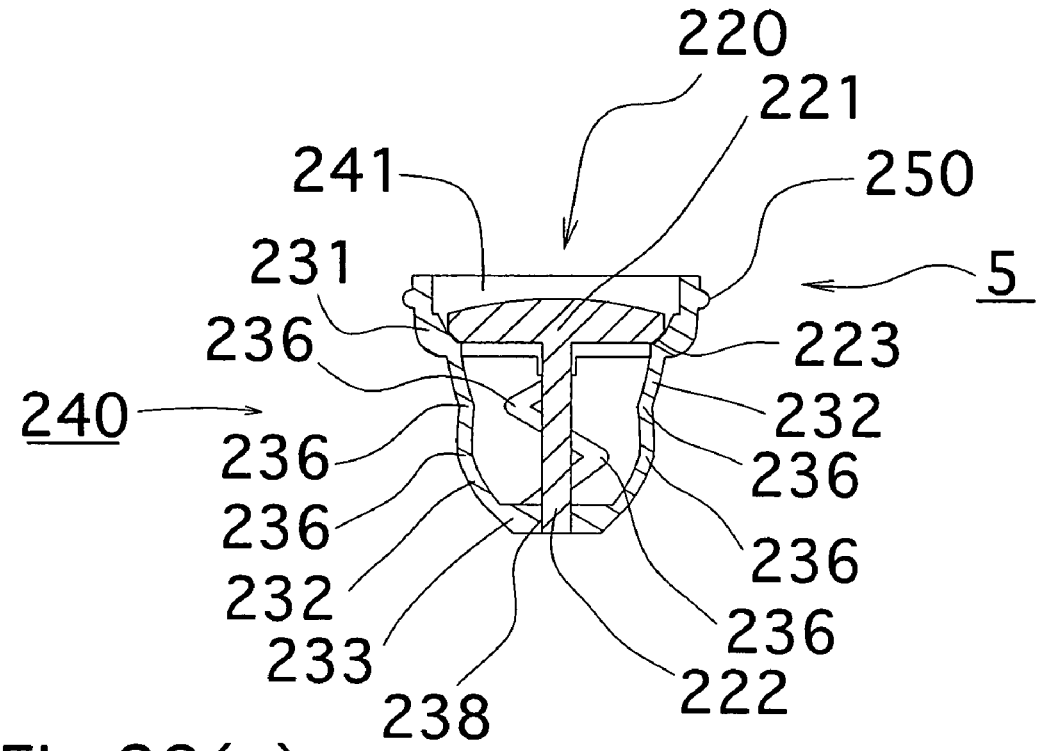
FIG. 23(*a*) is a longitudinal sectional view showing the valve mechanism used for the fluid-storing container when the opening portion is closed.
Figure 23B:
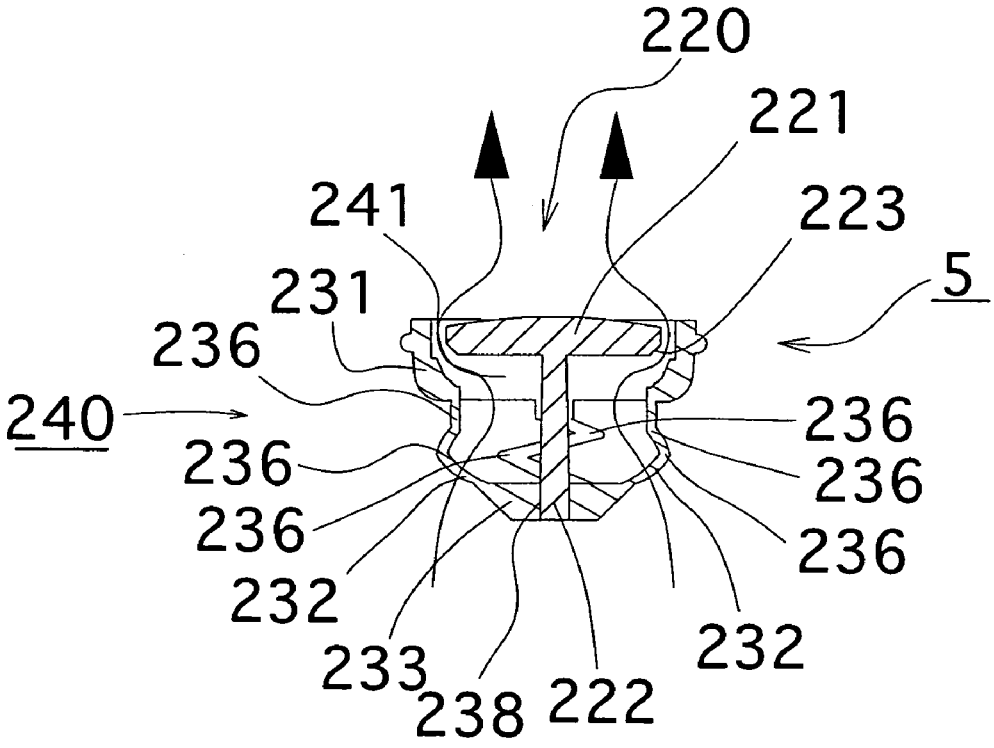

FIG. 23(*a*) is a longitudinal section showing a position in which the opening portion 241 of the valve mechanism 5 used for the fluid-storing container according to the present invention is closed. FIG. 23(*b*) is a longitudinal section showing a position in which the opening portion 241 of the valve mechanism 5 used for the fluid-storing container according to the present invention is opened.

This valve mechanism comprises a valve material 220 and a valve seat material 240.

The valve material 220 has a valve body 221 having a shape corresponding to the circular opening portion 241 in the valve seat material 240 described later, and a joined portion 222 set up by standing it in the valve body 221.

The valve seat material 240 has a circular opening portion 241, an engaging portion 231 engaging with the hollow portion of the coupling material 140, a valve material supporting portion supporting the joined portion 222 of the valve material 220, and four coupling portions 232 coupling the engaging portion 231 and the valve material supporting portion 233. In the valve material-supporting portion 233, a hole 238 for inserting/fitting the joined portion 232 in the valve material 220 is formed. By inserting/fitting the joined portion 222 in this hole 238 after passing through the opening portion 241 of the valve seat material 240 described later, the valve material 220 is fixed with the valve seat material 250. Four coupling portions 232 comprise a flexible resin having a pair of flexions respectively. By the flexibility of this coupling portions 232, the valve body 221 in the valve material 220 is adapted to be movable between a closing position in which the opening portion 241 in the valve seat material 240 is closed and an opening position in which the opening portion 241 in the valve seat material 240 is opened.

The opening portion 241 functions as a valve seat of the valve body 221; an inclined plane 245 forming the opening portion 241 has an angle corresponding to an angle of an inclined plane 223 of the valve body 221 in the valve material 220.

In the valve mechanism 5 having this configuration, when pressure is applied to the fluid inside the internal container 120 by pressing the body portion 112 of the fluid-storing portion 4, the valve body 221 in the valve material 120 moves to the opening position in which the opening portion 241 in the valve seat material 240 is opened as shown in FIG. 19 and FIG. 22. By this motion, the fluid passes through the opening portion 241. When the pressure applied to the body portion 112 of the fluid-storing portion 4 is removed, the valve body 221 in the valve material 220 moves to the closing position in which the opening portion 241 in the valve seat material 240 is closed by the valve body 221 in the valve material 220 by elastic restoring force of four coupling portions 232 as shown in FIG. 20. By this mechanism, penetration of the air into the internal container 120 from the opening portion 241 can be prevented.

With this configuration of the valve mechanism, back flow of the air into the internal container 120 from the outside can be prevented. As a result, contacting of the fluid stored with the air can be prevented. Decaying the fluid stored thus can be prevented.

The configuration of the valve mechanism is not limited to the above-mentioned; any configuration having a feature capable of opening the opening portion if the body portion 112 of the fluid-storing portion 4 is pressed and closing the opening portion if the pressure applied to the opening portion 112 is removed can be used.

Effects

As described above, the present invention exhibits various advantages including, but not limited to, the following:

According to an embodiment of the invention, where the runoff prevention mechanism is provided, it can prevent flowing out of the fluid from the internal space formed between the external container and the internal container to the outside, and it enables flowing in of the air from the outside to the internal space. Thus, it is not necessary to provide an air hole in the external container or a part of the lid, and the fluid from leaking outside can be prevented.

Additionally, because there is no need for providing an air hole in the external container, it can use containers available on the market without any modification.

According to another embodiment of the invention, where the fluid discharge pump is disposed inside the nearly cylinder-shaped coupling material, it can support the fluid discharge pump stably.

According to still another embodiment of the invention, where the valve mechanism is disposed inside the nearly cylinder-shaped coupling material, it can support the fluid discharge pump stably.

According to yet another embodiment of the invention, where the through-bore passing through between the outside and the internal space is formed in the coupling material, it can prevent pressure increase in the internal space with volume increase of the internal container when the fluid is filled. Additionally, when the through-bore closing material is provided, it closes the through-bore, outside the coupling material, and it can prevent flowing out of the fluid from the internal space after the fluid is filled.

According to still another embodiment of the invention, where the runoff prevention mechanism comprises flexible leakproof portions having an umbrella shape which open out toward an internal direction of the external container and whose maximum outer diameter portions contact the opening portion of the external container, it can prevent leakage of the fluid to the outside even when the fluid leaks into the internal space due to damage to the internal container, etc., although the configuration is simple.

This application claims priority to Japanese Patent Application No. 2002-375799, filed Dec. 26, 2002, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A coupling structure for a double-wall container, comprising:

a hollow portion having a through-hole as a fluid passage;

a flange portion provided at an upper end of the hollow portion;

a first connecting portion provided at a lower end of the hollow portion and adapted to be connected with an opening portion of an inner container;

a second connecting portion provided in the vicinity of the flange portion and adapted to be connected with an opening portion of an outer container;

at least one annular elastic fin provided between the first connecting portion and the second connecting portion, said annular elastic fin extending outward and downward, wherein an edge of the fin is adapted to be in contact with an inner wall of the opening portion of the outer container, and at least one groove as an air passage formed and extending through the flange portion and the second connecting portion, said groove remaining open when the opening portion of the outer container is connected with the second connecting portion, wherein the hollow portion has at least one through-bore which communicates (i) a space defined between the inner container connected with the first connecting portion and the outer container connected with the second connecting portion, and (ii) a space defined on top of the flange portion, and which is isolated from the hollow of the hollow portion, wherein the through-bore is formed from between the fin and the first connecting portion to the top through the flange portion.

2. The structure according to claim 1, wherein a space is defined between the inner container connected with the first connecting portion and the outer container connected with the second connecting portion, and the fin is such that when pressure in the space increases, the fin is deformed upward to increase sealing between the edge of the fin and the inner wall of the opening portion of the outer container, and when pressure in the space decreases, the fin is deformed downward to decrease sealing between the edge of the fin and the inner wall of the opening portion of the outer container, thereby introducing air into the space through the groove.

3. The structure according to claim 1, wherein the hollow portion is cylindrical.

4. The structure according to claim 1, wherein the second connecting portion has an annular convex portion.

5. The structure according to claim 1, which is made of an elastic resin composition.

6. The coupling structure according to claim 1, further comprising a through-bore closing disk adapted to be placed on top of the flange portion to close the through-bore without closing the hollow of the hollow portion.

7. A coupling structure for a double-wall container, comprising;

a hollow portion having a through-hole as a fluid passage;

a flange portion provided at an tipper end of the hollow portion;

a first connecting portion provided at a lower end of the hollow portion and adapted to be connected with an opening portion of an inner container;

a second connecting portion provided in the vicinity of the flange portion and adapted to be connected with an opening portion of an outer container;

at least one annular elastic fin provided between the first connecting portion and the second connecting portion, said annular elastic fin extending outward and downward, wherein an edge of the fin is adapted to be in contact with an inner wall of the opening portion of the outer container, and at least one groove as an air passage formed and extending through the flange portion and the second connecting portion, said groove remaining open when the opening portion of the outer container is connected with the second connecting portion, wherein the hollow portion has at least one through-bore which communicates (i) a space defined between the inner container connected with the first connecting portion and the outer container connected with the second connecting portion, and (ii) a space defined on top of the flange portion, and which is isolated from the hollow of the hollow portion, said coupling structure further comprising a through-bore closing disk adapted to be placed on top of the flange portion to close the through-bore without closing the hollow of the hollow portion.

8. A fluid-storing container comprising:

an inner container for storing a fluid, which is flexible;

an outer container in which the inner container is placed;

a coupling member having a hollow portion having a through-hole as a fluid passage;

a flange portion provided at an upper end of the hollow portion;

a first connecting portion provided at a lower end of the hollow portion and adapted to be connected with an opening portion of an inner container;

a second connecting portion provided in the vicinity of the flange portion and adapted to be connected with an opening portion of an outer container;

at least one annular elastic fin provided between the first connecting portion and the second connecting portion, said annular elastic fin extending outward and downward, wherein an edge of the fin is adapted to be in contact with an inner wall of the opening portion of the outer container, and at least one groove as an air passage formed and extending through the flange portion and the second connecting portion, said groove remaining open when the opening portion of the outer container is connected with the second connecting portion;

the coupling structure coupling the inner container and the outer container, herein an opening portion of the inner container is connected with the first connecting portion, an opening portion of the outer container is connected with the second connecting portion, and the edge of the fin is in contact with an inner wall of the opening portion of the outer container;

a though-bore closing disk which is placed on top of the flange portion, wherein the through-bore closing disk closes the through-bore without closing the hollow of the hollow portion; and a nozzle portion which is secured to the opening portion of the outer container, between which the flange portion and the through-bore closing disk are sandwiched, wherein the fluid stored in the inner container is dispensed from a discharge port of the nozzle portion through the hollow of the hollow portion.

9. The fluid-storing container according to claim 8, wherein the outer container has no air hole.

10. The fluid-storing container according to claim 9, wherein the nozzle portion comprises a lid provided with the discharge port, and a valve mechanism fitted inside the hollow portion of the coupling member.

11. The fluid-storing container according to claim 10, wherein the valve mechanism comprises:

a valve seat portion fitted to an inner wall of the hollow portion, said valve seat portion having a fluid passage;

a valve body for closing and opening the fluid passage; and a valve body support portion for supporting and urging the valve body downward.

12. The fluid-storing container according to claim 11, wherein the valve seat portion has an annular convex portion to be fitted to the inner wall of the hollow portion.

13. The fluid-storing container according to claim 10, wherein the outer container is flexible.

14. The fluid-storing container according to claim 8, wherein the nozzle portion comprises a nozzle head provided with the discharge port, a lid secured to the opening portion of the outer container, and a pump mechanism for pumping the fluid from the inner container to the discharge port by pushing the nozzle head.

15. The fluid-storing container according to claim 8, wherein the pump mechanism comprises:

a cylinder fitted inside the hollow portion of the coupling member, said cylinder having a lower end provided with a valve;

a piston which reciprocally slides against an inner wall of the cylinder to introduce the fluid therein through the valve and discharge the fluid through the discharge port;

a hollow rod for moving the piston, said rod being connected to the discharge port, wherein the fluid is discharged through the rod from the discharge port; and an urging member for urging the hollow rod upward.

16. The fluid-storing container according to claim 15, wherein the cylinder has a flange portion, and the lid is secured to the opening portion of the outer container, between which the flange portion of the cylinder, the through-bore closing disk, and the flange portion of the coupling member are sandwiched.

17. The fluid-storing container according to claim 15, further comprising a suction tube having an upper end and a lower end, said upper end being connected to the lower end of the cylinder, said lower end being disposed near a bottom of the inner container, wherein the fluid is introduced into the cylinder through the suction tube.

18. A fluid-storing container comprising:

an external container on top of which an opening portion is formed;

an internal container which comprises a flexible bag body having an opening portion and which can be housed inside said external container;

a nearly cylinder-shaped coupling material disposed at the opening portion of said internal container, which enables a fluid stored inside said internal container to be discharged outside via the opening portion of said external container and forms an internal space shielded from the outside between said internal container and said external container by fixing the opening portion of said internal container in the vicinity of the opening portion of said external container; and a fluid discharge pump for discharging the fluid stored inside said internal container from a nozzle head disposed over said external container by pressing said nozzle head in an axial direction of the fluid discharge pump, wherein the fluid discharge pump and the coupling material is disposed co-axially, wherein said coupling material comprises a runoff prevention mechanism comprising;

at least one flexible leak proof fin and a groove portion which prevent the fluid from flowing out from said internal space to the outside and enables air to flow into said internal space from the outside.

19. The fluid-storing container according to claim 18, wherein said fluid discharge pump is disposed inside said nearly cylinder-shaped coupling material.

20. A fluid-storing container comprising:

an external container on top of which an opening portion is formed;

an internal container which comprises a flexible bag body having an opening portion and which can be housed inside said external container;

a nearly cylinder-shaped coupling material disposed at the opening portion of said internal container, which enables a fluid stored inside said internal container to be discharged outside via the opening portion of said external container and forms an internal space shielded from the outside between said internal container and said external container by fixing the opening portion of said internal container in the vicinity of the opening portion of said external container; and a fluid discharge pump for discharging the fluid stored inside said internal container from a nozzle head disposed over said external container by pressing said nozzle head, wherein said coupling material comprises a runoff prevention mechanism which prevents the fluid from flowing out from said internal space to the outside and enables air to flow into said internal space from the outside, wherein said runoff prevention mechanism comprises flexible leakproof portions having an umbrella shape which opens toward an internal direction of the external container and which has maximum outer diameter portions contacting an inner wall of the opening portion of the external container.

21. The fluid-storing container according to claim 20, wherein said runoff prevention mechanism comprises a through-bore passing through between the outside and said internal space, which is formed in said coupling material, and a through-bore closing material closing said through-bore, which is disposed on top of said coupling material.

22. A fluid-storing container comprising:

an external container on top of which an opening portion is formed;

an internal container which comprises a flexible bag body having an opening portion and which can be housed inside said external container;

a nearly cylinder-shaped coupling material disposed at the opening portion of said internal container, which enables a fluid stored inside said internal container to be discharged outside via the opening portion of said external container and forms an internal space shielded from the outside between said internal container and said external container by fixing the opening portion of said internal container in the vicinity of the opening portion of said external container; and a valve mechanism for discharging the fluid stored inside said internal container from an upper portion of said external container by applying pressure to the fluid stored inside said internal container, wherein said coupling material comprises a runoff prevention mechanism which prevents the fluid from flowing out from said internal space to the outside and enables air to flow into said internal space from the outside, wherein said runoff prevention mechanism comprises flexible leakproof portions having an umbrella shape which opens toward an internal direction of the external container and which has maximum outer diameter portions contacting an inner wall of the opening portion of the external container.

23. The fluid-storing container according to claim 22, wherein said valve mechanism is disposed inside said nearly cylinder-shaped coupling material.

24. The fluid-storing container according to claim 22, wherein said runoff prevention mechanism comprises a through-bore passing through between the outside and said internal space, which is formed in said coupling material, and a through-bore closing material closing said through-bore, which is disposed on top of said coupling material.

* * * * *